US008709361B2

(12) United States Patent
Gueller et al.

(10) Patent No.: US 8,709,361 B2
(45) Date of Patent: Apr. 29, 2014

(54) METHOD FOR CARRYING OUT A CHEMICAL REACTION

(75) Inventors: Rolf Gueller, Herznach (CH); Josef Schröer, Muttenz (CH); Christelle Jablonski, Steinbrunn Le Haut (FR)

(73) Assignee: Chemspeed Technologies AG, Augst (CH)

( * ) Notice: Subject to any disclaimer, the term of this patent is extended or adjusted under 35 U.S.C. 154(b) by 2238 days.

(21) Appl. No.: 10/344,839

(22) PCT Filed: Aug. 9, 2001

(86) PCT No.: PCT/CH01/00485

§ 371 (c)(1),
(2), (4) Date: Dec. 11, 2003

(87) PCT Pub. No.: WO02/13969

PCT Pub. Date: Feb. 21, 2002

(65) Prior Publication Data

US 2004/0235046 A1 Nov. 25, 2004

(30) Foreign Application Priority Data

Aug. 14, 2000 (CH) ..... 1577/00

(51) Int. Cl.
*B01L 3/00* (2006.01)

(52) U.S. Cl.
USPC ..... 422/547; 422/552; 434/298

(58) Field of Classification Search
USPC ..... 422/547, 552; 436/174; 434/298
See application file for complete search history.

(56) References Cited

U.S. PATENT DOCUMENTS

| | | | | |
|---|---|---|---|---|
| 3,554,705 | A | 1/1971 | Johnston et al. | |
| 3,713,985 | A * | 1/1973 | Astle | 435/33 |
| 4,062,652 | A | 12/1977 | Rolfo-Fontana | |
| 4,153,512 | A * | 5/1979 | Messner et al. | 435/33 |
| 5,804,141 | A * | 9/1998 | Chianese | 422/63 |

FOREIGN PATENT DOCUMENTS

| | | |
|---|---|---|
| DE | 24 33 616 | 8/1975 |
| DE | 4118538 | 12/1992 |
| DE | 44 19 759 | 12/1995 |
| WO | WO 96/28248 | 9/1996 |
| WO | WO 97/31217 | 8/1997 |
| WO | WO 98/10866 | 3/1998 |
| WO | WO 98/57738 | 12/1998 |

OTHER PUBLICATIONS

International Search Report for International Application No. PCT/CH01/00485, Oct. 22, 2001.

* cited by examiner

*Primary Examiner* — Jill Warden
(74) *Attorney, Agent, or Firm* — Husch Blackwell LLP

(57) ABSTRACT

Eight containers (1) containing substances (602, 702) are held in holes (71) in a support (70). The eight containers (1) containing different substances or the same substances in different amounts graduated in mole equivalents form a set (69) of containers containing substances, which set can be used for carrying out a chemical reaction.

33 Claims, 23 Drawing Sheets

Fig.15.1
40
$b_4$
Fig.15.2
40'
44
45
47
48
Fig.15.3
44'
45'
42
304
301'
$b_4$
Fig.15.4
41
46

405
501
403
902
404
406
$b_5$ 503
601
1002
$b_6$ 701
505
506
603
75
76
1102
504
$b_7$ 605
801
703
77
606
1202
604
$b_8$ 705
901
803
78
1302
704
$CH_3COCl$
$b_9$

Fig.28
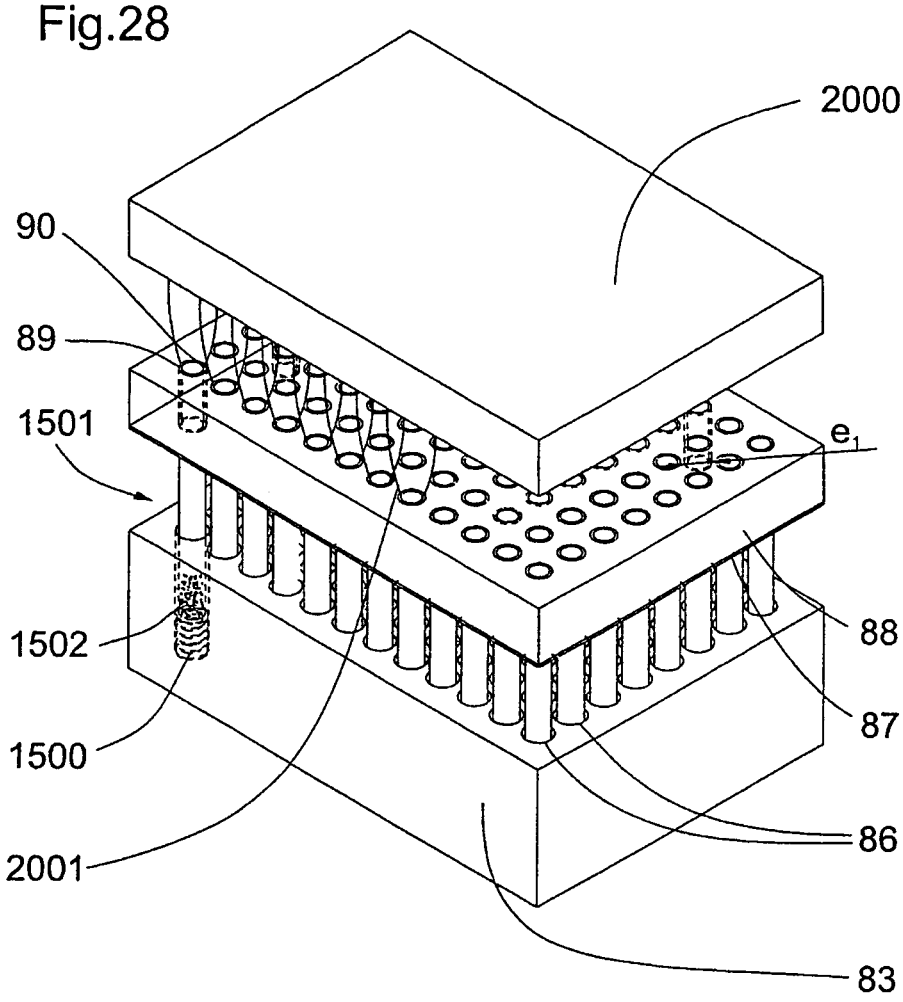
Fig.28.1
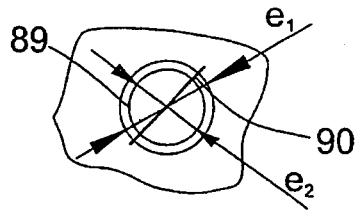

798
1205
1201
1203
1208
1202
1204
$b_{12}$
1206

1205
1201
1203
1206
1202
1204
$b_{12}$ 1205
1201
1206
1202
1204
1207
1206

$b_{13}$
99

2003
99'

$d_{13}$
2003
99''

$d_{13}$
99''
2004

METHOD FOR CARRYING OUT A CHEMICAL REACTION

The present invention relates to a method for carrying out a chemical reaction between at least a first substance and a second substance, in which a premetered amount of the first substance and a premetered amount of the second substance which is the molar equivalent of the premetered amount of the first substance or is graduated thereto based on mole equivalents are used, to a set of containers containing substances and to a container which is sealed air-tight and contains a premetered amount of a substance. In chemical and other research and development in which the properties of a substance are changed at the molecular level, in particular in the chemical industry, the life sciences industry, universities and other institutions, it is becoming more and more important to discover, as quickly, safely and economically as possible, a large number of potential active substances, materials or more generally expressed chemical substances or mixtures of substances having marketable properties or reactions or reaction sequences which lead to already known substances having such properties. These are then tested or analyzed. Today, a part of chemical research therefore relates to combinatorial chemistry, parallel synthesis, high-speed chemistry and parallel process optimization. Of key importance here is the possibility of being able to use known or novel chemical reaction types as widely as possible with as few adaptations as possible or of being able to optimize a process with respect to its reaction conditions or starting materials.

A very wide range of apparatuses and methods for carrying out a large number of chemical, biochemical or physical processes in parallel have therefore been provided. It has been found that the more the efficiency and automation in the implementation of chemical, biochemical or physical processes advance, the more the bottleneck is shifted to the logistical side, i.e. to the preparation of reactions before they can be started.

Even in the classical chemical synthesis, i.e. those generally carried out individually or purely sequentially, there is an increasing need for improving the preparatory work for the synthesis, such as, for example, the ordering, the stockkeeping, the weighing or metering, etc. of the chemical compounds, complexes, mixtures, etc. (referred to below as substances) required for the corresponding chemical synthesis, in such a way that said work can be implemented more quickly or, more generally, economically and ecologically more efficiently, in particular the stockkeeping of the substances reduced and made more efficient and the generally high percentage of wastes which result from the fact that often only portions of the ordered amount are used is reduced.

Chemical and biochemical reactions are usually carried out in such a way that a specific number of a first atom or molecule or complex, etc. (usually expressed in moles) is spatially combined with a generally specific number of a second atom, molecule, complex, etc. and possibly further generally specific numbers of atoms, molecules, complexes, etc. under more or less exactly defined conditions so that the various atoms or molecules or complexes, etc. react with one another. In organic and inorganic chemistry, the reactions are often carried out in a solvent.

The result of a chemical reaction is abbreviated below to product, and the starting materials are referred to as substances. Substances are also intended to mean those which only indirectly or only potentially influence the stoichiometry of the product to be formed or do not influence it at all and are fed in for any other reason, such as, for example, solvents, catalysts, activators, inhibitors, etc. The conditions under which the substances are combined until the desired product forms are referred to as reaction conditions.

The ratio of the substances to one another, based on the smallest chemical unit (atom, molecule, complex, etc.) of the substances, is referred to as the molecular ratio or, if the macroscopic expression is used, as the molar ratio of the substances. In most chemical reactions, this ratio is more or less decisive, or it is at least important for the experimenter to know this ratio more or less exactly. Particularly in research and development, the ratio of the substances to one another is generally more important than the respective absolute amounts, at least in a certain range, such as, for example, a factor of 2.

Since the number of atoms, molecules, complexes, etc. cannot be economically counted using the technical equipment available today, the ratios of the substances are generally determined by means of their weight or volume with the aid of the atomic or molecular weight. This means that the experimenter, who may be either an individual or a robot or an automatic or semiautomatic system, thus determines, before each experiment, those ratios of the starting materials which he desires. He then decides on the absolute magnitudes with which he will carry out the corresponding experiment, these in most cases not being absolutely decisive in a certain range. In the next step, he uses the atomic or molecular weight (in the case of mixtures, the mean value, etc.) to calculate the macroscopic quantity to be dimensioned, i.e. the weight or, via the density, the volume. He then weighs in the starting materials or separates off the determined volume, for example, from a storage vessel and combines the starting materials under the reaction conditions determined by him.

This method is very complicated, time-consuming and, especially when carrying out many reactions, is associated with many potential sources of errors. Furthermore, in chemical research and development, the smallest possible amount of a certain substance over and above the amount to be used, usually introduced in a gravimetric or volumetric unit into a container, is generally ordered. Of this amount, often only a fraction is used for the planned experiment. The remainder is then usually stored for later experiments, it frequently no longer being possible to seal the container optimally. Consequently, vapors which are unpleasant and/or hazardous to health are sometimes released in the storage rooms. Furthermore, this storage of a very wide range, often thousands, of compounds generally constitutes a safety risk. Often, the substances have to be disposed of at some point in time or ideally sent back to the manufacturer. This gives rise not only to costs but also to further risks and often ecological problems as a consequence of the disposal.

Another disadvantage of the procedure to date is that the substances generally have to be handled in the open and, in the case of very volatile, very sensitive or very toxic substances, a large number of safety measures and precautions have to be taken. If such measures are omitted or are not adequately present, it is even possible for the quality of the substances to suffer, which may influence the experiment in an undesired manner or even cause it to fail. This may also be the case when a container is opened several times, substance removed and the container closed again, since there is a danger of contamination.

Today, approximately 20 000 fine chemicals most frequently used in chemical and biochemical research and development are generally available in kilogram, gram, milligram, microgram, liter, milliliter or microliter quantities in a very wide range of containers. This has the disadvantage that, after calculation of the molar ratios and conversion into the gravimetric or volumetric unit, a corresponding amount has to be weighed or measured manually or by means of special apparatuses, for each reaction or group of reactions to be carried out. Even if this is carried out using automatic devices or apparatuses, this process constitutes tedious and troublesome work associated with the problems described above. Since, moreover, the chemical compounds are present in all possible states of aggregation, different metering systems have to be used. This is not only very expensive but in many cases, particularly with regard to automation, a problem which has not been optimally solved, in particular taking into account the diversity of even only the states of aggregation, but also other factors, such as, for example, safety requirements or the maintenance of quality. Furthermore, it is generally also necessary for the determination of the state of aggregation of a substance to be carried out by the experimenter.

For example, WO 98/10866 or WO 96/28248 discloses the use of containers with a premetered amount of a substance in the case of certain biochemical reactions. However, the various reaction substances used are not matched with one another in terms of molar amounts since this is not at all important in these special reactions. Moreover, in particular the substance containers cannot be used for carrying out any desired chemical reactions.

In view of the disadvantages of the methods known to date and described above for carrying out chemical reactions and containers containing substances, the invention has the following object. It is intended to provide a method and a set of containers containing substances, which permit chemical reactions to be carried out more efficiently economically and/or ecologically and/or with respect to safety risks, or permit the preparation therefor. In particular, the preparatory work for the reaction, which includes the ordering, the stockkeeping, the weighing or metering, etc. of the substances required for the corresponding chemical reaction, is to be improved in such a way that it can be implemented more quickly and with a lower level of risk. Preferably, the method and the set should be capable of being used in as broad a spectrum as possible.

The essential feature of the invention with regard to the method is that, in a method for carrying out a chemical reaction between at least one first substance and a second substance, in which a premetered amount of first substance and a premetered amount of the second substance which is the molar equivalent of the premetered amount of the first substance or is graduated thereto based on mole equivalents are used, at least one of the substances is present in at least one container, which is sealed air-tight and contains a premetered amount of the substance, and is substantially completely released from said container and is substantially completely used in the reaction.

By means of the method according to the invention, the at least one substance which as a rule, but not necessarily, has already been packed air-tight and premetered into the container by the manufacturer, is as a rule released shortly before addition to the reaction space or only in the reaction space itself and is substantially completely used in the reaction. This means that substantially the total premetered amount is brought to the site of the reaction. Owing to the premetered amount, the user can dispense with the time-consuming weighing in or measuring of the substance. Consequently, the substance itself is also exposed to minimum handling by the user outside the reaction space, i.e. the space in which the substance is reacted, with the result that contact with the environment of the reaction space, which as a rule contains atmospheric oxygen and water vapor, is restricted to a minimum, which in turn minimizes the danger of oxidation or of hydrolysis, particularly in the case of oxygen- and water-sensitive substances. Consequently, the user reacts exactly the substance in exactly the purity which he has planned, with greater probability than in a classical metering, i.e. by means of prior weighing, measuring, transfering, etc. Since the logistics are further standardized by the invention, it is possible to invest more in apparatuses and devices which operate more accurately and under better controled conditions than if the preparatory work were carried out individually by the user himself before each reaction.

Thus, the purities of the substances, the absolute amounts and the molar ratios of the substances to one another are much more exact, in turn making the experiments as a rule more informative.

Since the containers each contain a premetered amount of a substance which is substantially completely released and then reacted, the vessel is not opened and closed again, as in the classical method in which, as a rule, a specific amount is taken from a larger vessel, but each container is filled, sealed air-tight and no longer opened until the reaction of the substance. Thus, it is ensured to a far greater extent that the substance which is reacted is exactly that which it has been planned to react. Moreover, the often dangerous, expensive stockkeeping which results in the spread of odors owing to containers often no longer being sealed absolutely air-tight by the user is considerably reduced.

In addition, to date often only a relatively small fraction has been taken from larger containers whose quantities of substance are generally substantially greater than the amounts reacted in a chemical reaction in chemical research and development. The remainder often has to be disposed of because the same substance is no longer required within a useful period. The problem of having to dispose of excess substance is absent in the case of the containers premetered according to the invention.

Furthermore, owing to the generally smaller amounts of substance in the premetered containers, the potential danger during transport and stockkeeping is reduced. In addition, the costs to the user are generally lower since he can order exactly that amount of substance which he also intends to release and react in a planned chemical reaction, in particular when, as is often the case, he plans to use only a fraction of the minimum order quantities of conventional containers.

It should also be taken into account that the substances used have a very wide range of macroscopic forms, e.g. states of aggregation, particle sizes, densities and viscosities, and that there are also chemicals which, for example, have states of aggregation which are difficult to handle under room conditions, e.g. waxes, substances having a melting point of from 10° C. to 30° C., gases and semicrystalline substances. The premetered containers make it possible to eliminate these differences, i.e. to make them as far as possible unimportant for the user (researcher, robot, automatic apparatus, etc.) with respect to handling.

From another point of view, the method according to the invention makes it possible for the suppliers of fine chemicals to bring the net product chain closer to the application without having to infringe the user's know how-critical reservations, in order to be able to offer the user a permanent and valuable service.

Finally, it must be emphasized that it is true that it is desirable for as many chemicals as possible which are commercially available and used in chemical research and development to be made available in premetered containers. However, this is not absolutely essential, and the invention is effective independently thereof. The classical method of metering fine chemicals can be used in addition.

In the container, any space not filled with substance is advantageously substantially completely filled with a gas, a mixture of gases or a liquid, which gas, mixture or liquid contains less than 5%, preferably less than 1%, preferably less than 0.1%, of $O_2$. This has the advantage that particularly certain substances cannot be oxidized and, if the container is introduced, for example, unopened, for example into a reaction vessel, the $O_2$ does not influence the reaction, in particular does not oxidize certain other substances.

In at least one of the containers, the space not filled with substance is advantageously substantially completely filled with an inert gas, preferably $N_2$, $SF_6$, a chlorofluorocarbon or a noble gas, in particular Ar, Ne, Xe or He. Since, if the containers are not intentionally filled with an inert gas in the preparation, the space mentioned is as a rule filled with air and air contains relevant amounts of $O_2$, the abovementioned advantages are applicable. However, since they are also other potentially reactive gases, the inert gas atmosphere is the ideal case which does not substantially influence either the substance or the reaction mixture.

The substantially completely released substance substantially completely used in the reaction is advantageously at least partly reacted with the at least one further substance. In particular, those substances which are partly reacted are reactive substances and consequently, for example, sensitive to oxidation or to hydrolysis and are accordingly preferably already premetered and packed in the container as described (air-tight and under inert gas), so that the user need carry out as little handling as possible, such as, for example, weighing.

In a preferred embodiment, the substance is a catalyst, inhibitor, initiator or an accelerator. In particular, said substances are used in chemical reactions in relatively small to very small amounts. Accordingly, the abovementioned advantages apply to an even greater extent in the case of certain such substances.

The method according to the invention is advantageously characterized in that the container is tight to organic solvents, preferably generally to organic compounds. Advantageously, the container is tight to inorganic solvents, preferably generally to inorganic compounds. "Tight" is to be understood here as meaning that the organic compound cannot penetrate the container wall substantially (the standard is glass having a container wall thickness of 0.005 mm) without destroying it. This has the advantage that, if the container comes into contact with organic or inorganic compounds (before or after the addition of the container to the reaction space, i.e. also, for example, during storage), the substance present therein cannot be dissolved or react. Thus, both the quality of the substance and the safety until the use of the container, i.e. until the opening of the container, are ensured.

At least one, preferably at least two, of the substances is or are advantageously a pure chemical compound. In the majority of chemical reactions in chemical research and development, pure chemical compounds are used. Precisely because the substances are enclosed air-tight in the container and are released only before the reaction with further substances, the use of such containers for pure chemical compounds is expedient for ensuring the purity to a high degree.

Advantageously, at least one of the substances is a pure chemical compound in solution or suspension. Substances offered by the suppliers of fine chemicals for chemical research and development in solutions or suspensions are often offered in these because they are very sensitive, for example to hydrolysis, oxidation, etc., on contact with the environment. It is precisely for such substances that the containers sealed air-tight offer optimum conditions since the substance is released, with minimum handling, only shortly before the reaction or even during the reaction itself.

In a preferred embodiment, the chemical reaction is carried out in a, preferably organic, solvent or solvent mixture. The substances are as a rule released from the container shortly before addition to the solvent or even in this itself. In the solvent, they are once again protected from, for example, oxidation with atmospheric oxygen or hydrolysis by atmospheric humidity. Consequently, use of containers according to the invention is expedient precisely in solvent chemistry, especially since very sensitive chemical reactions are often carried out in solvents.

In the method according to the invention, a further substance which has no stoichiometric effect on the product resulting from the chemical reaction, preferably a catalyst, solvent, activator or inhibitor, is advantageously involved. Particularly in reactions in which catalysts, activators, inhibitors, etc. are involved, it is often necessary to use ultrapure chemical compounds in order not to disturb the course, such as, for example, not to "poison" the catalyst, inhibitor or activator.

In an advantageous embodiment, the reaction is an organic chemical reaction. Most reactions carried out in chemical research and development are organic chemical reactions, with the result that there is a considerable need for rationalization precisely in this area. This is also shown by the parallel synthesis method mostly used in this field.

The process is preferably characterized in that at least one of the substances is an organometallic compound. Since it is precisely organometallic compounds that are generally very sensitive to oxidation (e.g. by atmospheric oxygen) and hydrolysis, it is particularly expedient to premeter this class of compounds and to use them in air-tight form in containers, so that the handling outside the reaction space can be reduced to an absolute minimum and hence the quality or the content of the pure organometallic compound is not impaired.

The chemical reaction preferably takes place in a reaction vessel, the reaction conditions under which the substances are reacted with one another preferably differing from the conditions outside the reaction vessel. Particularly if the reaction is carried out in a reaction vessel, very special and controled conditions are often desired. At the same time, an attempt should also be made to ensure that the substance is exposed to the conditions outside the reaction vessel at least only to a slight extent, if at all. By using a premetered substance in a container which is sealed air-tight and is opened shortly before the addition to the reaction vessel or only in said vessel itself, this can be achieved with relatively little effort.

In a preferred embodiment, at least two, preferably a large number, of reactions are carried out in parallel, in each of which reactions at least one container sealed air-tight and containing in each case a premetered amount of substance which is released therefrom is used. In the parallel synthesis or the combinatorial chemistry, it is desirable for a user to be able to carry out more reactions per unit time. By using premetered containers, it is possible to dispense with the time-consuming metering by the user, often also under conditions which are complicated to control and at high concentrations. The user adds, for example to the reaction vessel, a substance premetered in a container in a very simple manner.

The reactions advantageously differ at least in one respect, either in the reaction conditions or in one of the substances used, in particular the amount thereof. Particularly if the substances used or the amounts thereof vary in, for example, reactions carried out in parallel, high concentration and an extremely time-consuming calculation, time-consuming weighing or metering in, often under special conditions, are required from the user, which is substantially dispensed with by adding a substance premetered in a container.

Preferably, at least two of the substances are present in each case in at least one container sealed air-tight and containing in each case a premetered amount of substance and are substantially completely released therefrom and used in the reaction. Most of the abovementioned advantages carry twice the weight if two substances premetered in containers are used and in addition the time-consuming calculation of the ratios of the mole equivalents is dispensed with in the case of appropriate premetering or at least is greatly simplified.

The substances in the container or containers advantageously have a molecular weight of less than 10 000, preferably less than 5 000, more preferably less than 1 000. Most substances sensitive to atmospheric oxygen or water vapor have relatively low molecular weights. For this reason, it is particularly advantageous to add these to the reaction in containers which release the substances only shortly before the reaction or in the reaction mixture itself.

The method is advantageously a chemical or biochemical synthesis method, preferably for the preparation of a product or product mixture to be investigated. In particular, chemical methods, to a lesser extent also biochemical methods, are sensitive to impurities which are formed, for example, by oxidation or hydrolysis of substances which originate from handling of said substances outside the reaction space. The results of measurements, analyses or, more generally, investigations of the product formed from the substances can be influenced thereby. By using premetered substances in containers which release them only shortly before the addition to the reaction space or even in said reaction space itself, the danger of such an effect on the results is often reduced.

In an advantageous embodiment, at least one of the substances is released by at least partial, preferably irreversible, elimination of the air-tight seal of the container in a reaction vessel. The release in the reaction vessel has the advantage that the substance is not contaminated during the feed. Irreversibly eliminating the air-tight seal of the container prevents the container from being sealed again.

Advantageously, at least one of the substances is released by at least partial, preferably irreversible, elimination of the air-tight seal of the container, directly where the reaction takes place. Because the substance is released only where the reaction takes place, the danger of a change in the substance, for example by oxidation by atmospheric oxygen, hydrolysis by water vapor, etc., before it undergoes the reaction is considerably reduced.

In another advantageous embodiment, at least one of the substances is released by at least partial, preferably irreversible, elimination of the air-tight seal of the container and then added to the at least one further substance.

The at least partial elimination of the air-tight seal of the container is preferably effected by the nontargeted use of a chemical, physical or mechanical action. If the containers are of a suitable design, for example, a container can be fed to a reaction mixture and, for example, irreversibly destroyed, if necessary only later, i.e. during the reaction, or individual containers at specific times during the reaction, by, for example, the action of a rotating magnetic stirrer, of ultrasound, of a solvent, of an explosive charge of any type, etc., and the substance subsequently released. As a result, not only are the advantages described above achieved, but the reaction can also be controled in a specific manner. This is expedient control from outside, in particular in the case of reactions which permit addition after the start of the reaction only with difficulty, if at all, as, for example, if the reaction is carried out in a container having an air-tight seal, if necessary under pressure, with the parallel implementation of many reactions in which metering can no longer be effected in parallel and simultaneously, etc.

In an advantageous embodiment, the at least partial elimination of the air-tight seal of the container is effected by opening the container at a point on the container which is intended for this purpose, in particular by separation at a predetermined breaking point. When a predetermined breaking point is present, the advantages described above can be utilized in a specific manner. Moreover, a higher reliability of the opening of the container is generally achieved. Furthermore, the predetermined breaking point can be differently designed, in particular with respect to material, and if necessary a compromise can be made regarding material properties for the relatively small amount of another material which, if necessary, is used for the predetermined breaking point, in that optimum, more exactly controlable release of the substance is achieved and allowances are made for this purpose if necessary with regard to not influencing the chemical reaction (for example by inert material).

In another advantageous embodiment, the opening of the container is effected by means of a tool with which the substance present in the container is then preferably added to the at least one further substance. The premetered form of the substance in the container can then be combined with the classical method in which the substance is fed to the reaction mixture without a container, in that, for example, a tool opens the container and, for example, ejects the substance, allows it to run out, blows it out, etc. This is furthermore advantageous when a specific substance is to be slowly metered in. If the tool opens the container shortly before the addition to the reaction vessel, many of the abovementioned advantages are retained. If the tool opens the container in the reaction vessel or even only in the reaction mixture itself and the container releases the substance there, the abovementioned advantages are virtually all retained.

The opening of the container is advantageously effected by piercing the container, preferably by two-stage piercing, in which a container wall part is pierced in the first stage and an opposite container wall part in a second stage, a solvent preferably being fed to the interior of the container after the first stage. In this way, a substance can even be metered in as a solution in a solvent while retaining most of the abovementioned advantages, in that, for example, a robot needle which is connected to a solvent reservoir, such as, for example, a Gilson ASPEC 233, pierces a container wall part, meters in the appropriate amount of solvent, repeatedly aspirates it with thorough mixing and discharges the solution again into the container and if necessary aspirates it again and then pierces the opposite container wall part and meters the solution thus prepared directly into, for example, a reaction vessel. This process can be carried out in an appropriate apparatus (manual or automatic tool) even directly in the reaction vessel.

In another advantageous embodiment, the at least partial elimination of the air-tight seal of the container is effected by dissolution of the container or of a part of the container or by detachment of a part of the container. In the case of a container having the appropriate properties, targeted opening of the container can once again be achieved by, for example, a solvent outside or inside the reaction vessel.

In yet another advantageous embodiment, the at least partial elimination of the air-tight seal of the container is effected by destruction, preferably breaking, of the container. Opening by a nontargeted physical force was described above. For the destruction of the container, the same advantages apply in principle. For example, the time of metering can be exactly determined even if the containers have already been broken at an earlier time in the reaction vessel. Furthermore, the user can also break a suitable container by hand using gloves, directly over the reaction vessel, and empty the substance into the reaction vessel. This last variant is simple and makes it possible to feed the substance without a container to the reaction vessel while preserving many of the advantages described above.

The at least one container is advantageously made of a material which does not influence the reaction, preferably is chemically inert in the reaction, preferably at least partly of an inorganic material. For obvious reasons, the container should not be chemically attacked by the substance (contamination of the substance, danger to the environment, etc.). Ideally, the container material on the inside and outside is inert in a very wide chemical spectrum, so that the same container material can be used for as many substances as possible and hence fewer considerations and tests have to be carried out, both by the manufacturer and by the user himself. Furthermore, at least in some applications, it is advantageous if the container can be fed directly to the reaction mixture and releases the substance directly there. However, this is possible in an expedient manner only when the container material does not influence the reaction or, even better, is inert. To avoid the user having to make special considerations for every reaction, the container material is ideally inert to most substances used in the chemical synthesis and reaction mixtures used or at least does not have a substantial effect on most reactions.

Preferably, the at least one container is at least partly, preferably substantially completely, made of glass, preferably silicate glass, or a glass-like material. Most reaction vessels used today in organic chemistry are made of glass. Glass is considered to be a very inert material which does not influence the reactions in a wide range. Most users are familiar with the prospects and risks of glass. Apart from HF, there are only a few substances and reaction mixtures regularly used in chemical research and development to which glass is not resistant or at least on which glass has no influence. Glass also does not dissolve in organic and the vast majority of inorganic solvents, with the result that, if the container is added, for example, completely to the reaction mixture and the substance is thus released directly in the reaction mixture, it can easily be separated off, for example by filtering off from the reaction solution. Furthermore, glass is relatively easily breakable but, under certain conditions, is very suitable as a more or less stable container. The container wall thickness can be chosen, for example, so that, with good further packaging, the container can be transported in a relatively problem-free manner but can be broken by a magnetic stirrer in a reaction vessel.

Various containers in which a chemical substance is completely surrounded by glass are in principle conceivable.

In an advantageous embodiment, the at least one container at least partly comprises polymers. For certain substances, such as, for example, HF or HBr, polymers, in particular polyethylene and polypropylene, and, for special applications, polytetrafluoroethylene, are most suitable as container materials since they have the chemical stability necessary for such and similar compounds.

Advantageously, the at least one container is made at least partly of metal and contains in particular a gaseous substance. Gaseous substances, even under pressure, can be introduced as a whole into a reaction chamber and sealed air-tight. The container can be such that the gas is released into the reaction vessel under certain conditions, for example by breaking a glued seam, dissolving away a second material introduced into pores, etc.

The containers according to the invention can be designed similarly to commercially available disposable laboratory containers, such as, for example, test tubes, pipettes, ampoules, syringes, tubes with or without a screw closure, etc., which are modified in such a way that irreversible elimination of the air-tight seal is possible.

The premetered amount is advantageously from 1 nmol to 1 000 mol, preferably from 1 nmol to 10 mol, more preferably from 1 nmol to 1 mol, more preferably from 1 nmol to 100 mmol, more preferably from 1 nmol to 10 mmol. Particularly in the case of small batches (small amounts based on moles), the abovementioned advantages are particularly evident since the smaller the batch, the more difficult it is to handle the relative accuracy of the metering. On the other hand, the vast majority of chemical reactions in chemical research and development carried out on a scale of less than 1 000 mol, most on a scale of less than 10 mol and, particularly in chemical research, on the scale of less than 1 mol. Furthermore, the containers are particularly efficient precisely in the ranges mentioned and in the case of relatively small batches, especially since it is precisely the relatively small batches which are run much more frequently and now often in parallel.

The premetered amount is preferably 1, 2, 5, 10, 20, 50, 100, 200, 500, 1 000, 2 000, 5 000, 10 000, 20 000, 50 000, 100 000, 200 000, 500 000, 1 000 000, 2 000 000, 5 000 000, 10 000 000, 20 000 000, 50 000 000 or 1 000 000 000 nmol, preferably 1, 2, 5, 10, 20, 50, 100, 200, 500, 1 000, 2 000, 5 000, 10 000, 20 000, 50 000, 100 000, 200 000, 500 000, 1 000 000, 2 000 000, 5 000 000 or 10 000 000 nmol. It is precisely the graduation as in monetary systems which has proven useful with regard to simplicity of handling and are accordingly familiar to every user. With regard to overview and calculation of mole equivalents, they are simple to calculate.

The premetered amount is advantageously 1, 10, 100, 1 000, 10 000, 100 000, 1 000 000 or 1 000 000 000 nmol, preferably 1, 10, 100, 1 000, 10 000, 100 000 or 10 000 000 nmol. A decimal system of graduated containers is preferably simple to handle in terms of the overview. For the sake of simplicity and clarity, it is often accepted that more, but not too many, containers have to be used compared with the system described above in order to achieve the desired accuracy in the corresponding range.

Preferably, at least one first container with a first premetered amount of the first substance, at least one second container with a second premetered amount of the first substance which is graduated relative to the first premetered amount based on mole equivalents, and at least one third container with a premetered amount of the second substance which is the molar equivalent of the first premetered amount or is graduated thereto based on mole equivalents are used. Through the use of a plurality of premetered substances, the advantages discussed above are cumulative.

Advantageously, at least one first container with a first premetered amount of the first substance and at least one second container with a second premetered amount of the first substance which is graduated relative to the first premetered amount based on mole equivalents are used. The user can thus employ container sizes in such a way that, particularly if an expedient graduation (for example in a decimal system as described above) is present, he can achieve virtually any accuracy and does not have to have available one container each for every substance for every number of moles in a specific range, which would not only complicate the logistics and preparation but would also mean a loss of clarity.

Regarding the advantages of the subjects of further dependent method claims, reference is made to the following description of the set of containers containing substances according to the invention.

The essential feature of the invention with regard to the set of containers containing substances is that said set comprises at least one container with a first premetered amount of a first substance, at least one second container with a second premetered amount of the first substance which is graduated relative to the first premetered amount based on mole equivalents, and at least one third container with a premetered amount of a second substance which is the molar equivalent of the first premetered amount or of an integral multiple thereof.

Thus, the user has, for a specific intended use, a set of containers which contain substances and with which he can carry out various chemical reactions. This has the advantage that the substances can be very conveniently added with the aid of containers, from which the corresponding substances are usually substantially completely released, to the reaction space, possibly together with further substances which are added to the reaction space in a classical manner. Owing to the premetered amounts of the substances, the user can dispense with the time-consuming weighing in or measuring of the substance. Moreover, the substance itself is subjected to minimum handling by the user outside the reaction space, i.e. outside the space in which the substance is reacted, with the result that contact with the environment of the reaction space, which as a rule contains atmospheric oxygen or water vapor, is minimized, which in turn reduces the risk of oxidation or of hydrolysis to a minimum, particularly in the case of oxygen- and water-sensitive substances, with the result that the user reacts exactly the substance in the purity which he has planned to react with greater probability than in the case of classical metering.

The set furthermore has the advantage that not only one substance is present in premetered form in a container but in fact a set of substances provided in premetered form in containers. Such a set can be used for carrying out various reactions, for example with the use of at least one first and at least one third container which contain two different substances, possibly additionally with substances metered in classically. When one or more of the second containers, in which a second amount of the first substance which is graduated relative to the first premetered amount in the first container based on mole equivalents is present in premetered form, are used, it is possible to realize not only batch sizes which correspond to the first premetered amount in the first container or a multiple thereof but also intermediate sizes.

For example, it is also possible to realize two reactions in which a first substance from a first container is released in a first reaction and is reacted with a further substance, and a second substance from a third container is released in a second reaction and is reacted with a further substance, in such a way that the two reactions are molar equivalents, which can be achieved by virtue of the fact that the second premetered substance released from a third container is the molar equivalent of the first premetered amount of the first substance in the first container, or if necessary with the use of a corresponding number of containers. Particularly in parallel synthesis, it is desirable for different batches to be carried out on an equimolar basis. This results in greater clarity but also the same expected amount of product, which simplifies, for example, the subsequent metering, stockkeeping, dilution with a solvent with establishment of an identical concentration and the calculations for further reactions, etc. In chemical development, an equimolar reaction is frequently desired or even necessary since the absolute size of the batch often has a not insignificant effect on the reaction parameters and it is precisely these which in fact are to be investigated in such reactions.

It is also possible, for example if the amount of the premetered second substance in a third container corresponds to an integral multiple (factor z) of the amount of the first substance in a first container, to carry out a reaction in such a way that x/z equivalents of the first premetered substance are reacted with one equivalent of the second substance, where x is the number of first containers used. Since in turn a second premetered amount of the first substance is present in a second container and said amount is graduated relative to the first premetered amount of the first substance in the first container, further graduations based on mole equivalents can be realized.

Moreover, the statements made in connection with the method according to the invention, in particular concerning the explanations with regard to patent claim 1, are applicable. This also applies to the dependent patent claims which, for this reason, are explicitly discussed only partly below.

The set of containers containing substances is advantageously composed in such a way that the premetered amount of the second substance in the third container is the molar equivalent of the first premetered amount of the first substance in the first container. This ensures that, for carrying out the chemical reaction between an amount of the first substance and an amount of the second substance which is the molar equivalent of the amount of the first substance or a multiple thereof, the user can simply use a first container with the first substance and one or more third containers with the second substance where the desired molar ratio of the first substance to the second substance is 1:1. In the case of another desired molar ratio of the first substance to the second substance, the number of containers must be adapted correspondingly.

The premetered amounts of further substances in further containers are advantageously in each case molar equivalent amounts of the premetered amount of the first substance in the first container, or integral multiples thereof. This enables the user to carry out a multiplicity of reactions with the use of the conveniently handled set.

In an advantageous embodiment, at least one of the substances is a pure chemical compound, and preferably both substances are pure chemical compounds. Chemical reactions are carried out in most cases using pure compounds as starting substances (so-called starting materials). If a pure chemical compound is involved, the user knows exactly what he is using and can then also carry out the reaction relatively independently of the supplier of the corresponding fine chemicals. As a rule, such so-called pure chemical compounds are offered in each case in purities of from 90 to 99.999%. Often different degrees of purity, such as, for example, 98% and 99%, are also available. Both are considered to be pure chemical compounds in practice. In addition, an advantage of being premetered in a sealed container is precisely that the manufacturer of such containers can exactly define their contents and check them with regard to quality, and the containers preferably release substances only in the reaction vessel. This ensures that the purity which the manufacturer of the substance specifies does not suffer as a result of handling, such as, for example, weighing, of the substance outside the reaction vessel. This increases the reproducibility of the reaction.

The set of containers containing substances advantageously comprises a plurality of containers with different premetered substances in different amounts, the amounts in each case being graduated relative to mole equivalents. The set of substances is of greater advantage for the user the more compounds it contains which the user repeatedly uses. It is expedient to have available in premetered form in containers in particular the key chemicals which are most frequently used and those which are the most sensitive and complicated in terms of handling. An example of this is sodium hydride (NaH), which is generally available today suspended in an oil and often has to be freed from this before the reaction by washing with hexane. Since NaH is moreover highly sensitive to air, this constitutes a complicated, unsafe and labor-intensive procedure. The suspension in oil is offered in particular so that the NaH remains more or less stable at least during handling and does not react with the atmospheric humidity to give NaOH. Owing to similar difficulties of handling, premetering in sealed containers is particularly advantageous, for example also in the case of $K_2CO_3$, $LiAlH_4$, Na and $CH_3CH_2COO(COOCH_2CH_3)$.

The composition of the set of containers containing substances is preferably such that the at least one first container has x nmol of the first substance and the at least one second container has y·x/1 000 nmol of the first substance, where x and y are integers and y is preferably a number from 1 001 to 1 000 000, more preferably from 1 010 to 100 000, more preferably from 1 100 to 10 000. The vast majority of substances used in chemical research and development has a purity of less than 99.99% by weight. It is therefore expedient to choose for the amounts of substances in the containers a graduation which is substantially above this value for most substances. However, the graduation furthermore should not include excessively large steps, and the smallest premetered amount of substance should be sufficiently small that, for a desired amount of substance, preferably less than 1 000, more preferably less than 100, more preferably less than 10, containers have to be used and sufficient accuracy is achieved. The choice of the graduation is a matter of optimization, comparable with the choice of a monetary system, but for which a third dimension is encountered, namely that different substances exist.

In a preferred embodiment, y is 2 000, 3 000, 4 000, 5 000, 6 000, 7 000, 8 000, 9 000 or 10 000, preferably 2 000, 5 000 or 10 000, more preferably 5 000 or 10 000. Such a set of containers containing substances ensures that the range of graduation is convenient and hence advantageous for the user. Where y=2 000, the user can meter accurately to the amount x nmol and, in the range from x nmol to 2y/1 000 nmol, must in each case use two containers at the most for this purpose. This applies analogously to all values of y mentioned here, i.e. three containers for y=3 000, four containers for y=4 000, etc.

If three containers with different amounts of substance are used, for example of a substance as described above, it is advantageous that the y between the first and second and that between the second and third containers are not of equal magnitude, so that it is possible to introduce intermediate sizes, and fewer containers need be used while maintaining the same accuracy of metering. This in turn can considerably increase the user friendliness. It is precisely the graduation of a substance of x nmol, 2x nmol, 5x nmol and 10x nmol which is particularly advantageous and is, for example, also handled in this way in a decimal monetary system customary today. The graduation of a substance of x nmol, 5x nmol and 10x nmol in turn has the advantage that the user need handle fewer different container sizes and does not have to handle too many containers in the range mentioned. In the case of a y of 10 000, the user can still meter accurately to the amount x nmol and in each case has to use not more than 10 containers for this purpose in the range from x nmol to 2y/1 000 nmol, although he may have to handle slightly more containers altogether, but fewer different container sizes.

x is advantageously a number from 1 to 1 000 000 000 000, preferably from 1 to 10 000 000 000, more preferably from 1 to 1 000 000 000, preferably from 1 to 100 000 000, preferably from 1 to 10 000 000. These numbers arise from the fact that the set, according to the invention, of containers containing substances is used in particular in chemical research and development, and usually a range of from 1 nmol to 1 000 000 000 000 nmol, preferably from 1 to 10 000 000 000 nmol, more preferably from 1 to 1 000 000 000 nmol, more preferably from 1 to 100 000 000 nmol, more preferably from 1 to 10 000 000 nmol, is employed in this field of use.

The advantage of smaller containers is that they are simpler to handle and the release of the substance takes place as a rule more rapidly, with the result that concentration effects and other problems can be prevented. Moreover, in the case of a plurality of smaller containers, the metering of a substance can be effected stepwise as a function of time, which is often necessary particularly in chemical synthesis. In addition, for example, catalysts are used in relatively small amounts, for example from 0.001 to 10% of the amount of the stoichiometrically used substances. Since a range of from 1 000 nmol to about 1 000 000 000 nmol is predominantly employed today in chemical research and in the first phase of chemical development, a catalyst can still be metered in to 0.1% in this lowermost range by adding a container with a content of 1 nmol. Furthermore, for various reasons, for example use of fewer chemicals, reduction of the space required by the chemical reaction, particularly in parallel synthesis or combinatorial chemistry, the trend in chemical research is to reduce the batch size and to bring it into the micromolar and even nanomolar range. Particularly in the latter range, it is particularly important for the substances to be introduced in particularly pure form into the reaction space and to be metered particularly accurately. This is much more possible with the containers according to the invention since the containers are as a rule produced centrally and quality assurance measures and quality controls can be realized efficiently for a large number of centrally produced containers.

In a preferred embodiment, x is 1, 2, 5, 10, 20, 50, 100, 200, 500, 1 000, 2 000, 5 000, 10 000, 20 000, 50 000, 100 000, 200 000, 500 000, 1 000 000, 2 000 000, 5 000 000, 10 000 000, 20 000 000, 50 000 000 or 1 000 000 000, preferably 1, 2, 5, 10, 20, 50, 100, 200, 500, 1 000, 2 000, 5 000, 10 000, 20 000, 50 000, 100 000, 200 000, 500 000, 1 000 000, 2 000 000, 5 000 000 or 10 000 000, more preferably 1, 10, 100, 1 000, 10 000, 100 000, 1 000 000 or 10 000 000, more preferably 1, 10, 100, 1 000, 10 000, 100 000 or 1 000 000. This ensures that the container containing the smallest amount of the first substance is a more or less convenient size for the user to handle, and the graduation in the case of an appropriate y can correspond to the decimal system. This makes it easier for the user to think in the desired manner in terms of containers or equivalents.

The set according to the invention advantageously comprises at least three, preferably at least 5, more preferably at least 10, more preferably at least 100, more preferably at least 1 000, containers with different substances. The more substances the user has available in containers premetered in mole equivalents for his reactions, the more easily can he carry out a specific reaction without additionally having to resort to substances added in a classical manner.

The set of the containers with different substances preferably comprises in each case at least one, preferably at least three, more preferably at least five, further containers with the same substance in amounts graduated relative to the first premetered amount of the respective substance based on mole equivalents. This ensures that the user has available in each case two or more doses of the substances available in containers. This is advantageous since, in many reactions, the substances are not used in equimolar amounts and other amounts can be achieved by combining containers which are differently filled.

The containers of the different substances are preferably identically graduated relative to one another based on mole equivalents. So that the user effectively has to think virtually only in terms of containers or equivalents and, for a specific number of containers, as far as possible obtains the ratios of the equivalents of substances to one another directly and thus has to specify the absolute batch size only in the case of one substance, it is expedient not only that many substances are available in containers with some graduations but that the graduations are identical. If this is the case, the user acquires an overview and gains time. It is optimal if the user has available in containers all substances in his field of use so that all graduations based on the container content in moles are identical and he has no restrictions with regard to choice of substance and choice of accuracy and nevertheless can work exclusively with containers whose content in each case is used completely in the reaction.

BRIEF DESCRIPTION OF THE DRAWINGS

The method according to the invention for carrying out a chemical reaction and the set, according to the invention, of containers containing substances are described in detail below with reference to some embodiments. The figures show the following:

FIG. 28—the welding of the thin glass plate onto the 96 container blanks according to FIG. 27 with the aid of a fireproof plate;

FIG. 28.1—an enlarged section of FIG. 28, which shows an annular hole in the fireproof plate;

FIG. 1

Figure 1:
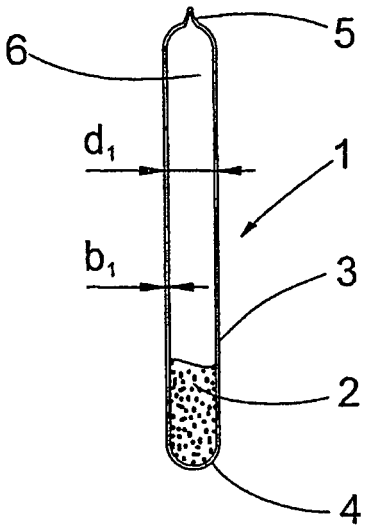
FIG. 1—a longitudinal section of an embodiment of a container according to the invention which is sealed air-tight and contains a premetered amount of a substance.

The container 1 according to the invention which is shown and is sealed air-tight contains a premetered amount of a substance 2. It comprises a cylindrical hollow body 3 which is sealed air-tight at the bottom by a spherical base 4 and at the top by a partly spherical cover 5 provided with a fused tip. The cylindrical hollow body 3 has the same diameter everywhere with the exception of the base region and cover region.

The wall thickness $b_1$ of the cylindrical hollow body 3 is small, for example 0.03 mm, relative to the external diameter $d_1$, which is, for example, 4 mm. Thus, it is possible to ensure, on the one hand, that the internal volume is as large as possible for given external dimensions and, on the other hand, if the glass is used as exclusive container material, that the container 1 is broken under the action of only relatively small external forces and the premetered substance 4 is released. Nevertheless, the container is still capable of being transported. The cavity 6 is as a rule filled with air under atmospheric pressure or, in the case of sensitive substances 2 or generally advantageously, with nitrogen, more advantageously with argon.

A small external diameter $d_1$ is desirable so that the container 1 can be introduced through as small a feed point as possible into a reaction vessel in which very special conditions often have to prevail. In order that sufficient substance can be introduced into the container 1, the latter is tubular, for example having a length of 50 mm.

The following statement is applicable for the further description. Where reference numerals are given in a figure for the purpose of clarity with respect to the drawings but are not explained in the directly associated description text, reference is made to their mention in the preceding description of the figures.

FIG. 2

The container not yet filled with a premetered amount of a substance 2 and not yet sealed air-tight is also referred to as blank 1'. It consists of a cylindrical hollow body 3' which is sealed air-tight at the lower end by a bottom part 4. In the embodiment shown, the entire test tube-like blank 1' is produced from a single material. The material used is, for example, metal, in particular stainless steel, Hastelloy™ or a titanium alloy, plastic, in particular PTFE, another polyfluorinated plastic, polypropylene, polyethylene, natural stone, in particular granite or gneiss, ceramic, in particular $Al_2O_3$ or MACOR™, or a glass, in particular borosilicate glass 3.3. Glass is particularly advantageous since it is chemically inert to very many chemicals and reaction mixtures used in chemical research and development and, after introduction of the premetered amount of a substance 2, particularly in the case of very thin-walled blanks 1', can be sealed relatively locally, in the opening region 8, by fusion and temperatures which are not too high, since the locally applied heat for melting the glass is transferred to the premetered amount of the substance 2 introduced prior to sealing by fusion to an extent tolerated by most chemical compounds, not least owing to the more or less acceptable heat insulation capacity of glass.

The introduction of the substance 2 into the blank 1' can be effected, for example, by means of a commercially available automatic metering apparatus.

FIG. 3

The blank 1" which has been filled with the premetered amount of the substance 2 and not yet sealed air-tight is sealed air-tight in the opening region 8'. Since, on the one hand, an exactly premetered amount (in mmol) of a substance is introduced during filling of the blanks 1' and, on the other hand, the blanks 1' are to be used for as large a range as possible of, on the one hand, different substances 2 and, on the other hand, different amounts, a cavity 6" usually forms, since the substance 2 is premetered not according to, for example, volume but according to the number of mmol. Since very many substances are sensitive to air, i.e. sensitive to oxygen and/or water, it is often necessary to fill the cavities 6" with a gas which is as chemically inert as possible before sealing by fusion. As a rule, either nitrogen or argon is used for this purpose. However, other gases or gas mixtures, in particular noble gases, are also suitable. For reasons of safety and standardization, this process can also be generalized without analyzing the specific negative potentials mentioned in the case of every substance 2. The filling of the cavities 6" with a gas can be achieved in various ways. Prior to sealing by fusion, argon can be introduced into the blank 1", for example by means of a needle to the upper end of which a tube is attached. Since argon is heavier than air and in each case forms a layer on the bottom, this is particularly simple in the case of this gas. Another variant comprises placing the entire apparatus in a space filled with inert gas, with the result that the cavity 6' is also automatically filled with the inert gas under certain, known conditions.

FIG. 4

A classical apparatus 11 for carrying out chemical reactions comprises an attached reflux condenser 12 having a reflux condenser cooling liquid space 26 and a reflux condenser interior 27, an oil bath 13 with oil bath containers 14, a magnetic stirrer motor 15 shown only schematically, a magnetic stirrer (also often referred to as magnetic stirring bar by chemists) 16 (in this case a doubly stepped cylinder comprising a magnetic core which is covered by a PTFE layer). A container 1 is just about to be added to the apparatus for carrying out a chemical reaction. The fragments 18 of a container which has already been introduced and broken are shown.

Container 1 is added via a reaction vessel opening 19 which at present is open, but can be closed, for example, by a stopper which has a standard ground glass joint 14.5 and is not shown. The container 1 is added to that opening of the two-necked flask which is not occupied by the reflux condenser 12. The reflux condenser is likewise connected to the reaction vessel 21 by means of a standard ground glass joint 14.5. At the upper end of the reflux condenser is a further ground glass joint 14.5 22, which leads to a tube coupling 23 which is provided with a tube 24. It is therefore advantageous to house argon under slightly superatmospheric pressure since this ensures that inert conditions are present even when the reaction vessel 21 is open briefly at the reaction vessel opening 19 by removing a stopper which is not shown.

As described, a container 1 has already been added to the reaction vessel 21 and has already been destroyed by the magnetic stirrer 16, and the corresponding substance 2 has already been substantially completely released. The substance 2 has dissolved in the reaction mixture and is no longer visible.

As an alternative, the container 2 could also be added through the opening at the standard ground glass joint 22, which has the disadvantage that no argon countercurrent would then be present in the apparatus 11.

The form of the cylindrical container 1 in this embodiment which is long relative to the external diameter $d_1$, makes it possible to achieve a relatively large internal volume 10 without loosing the advantage that the container 1 containing a premetered amount of a substance 2 and sealed air-tight can, after being sealed air-tight, be fed to the reaction vessel 21 through a relatively small opening 19 in said reaction vessel. This is often necessary since the container 1 containing a premetered amount of a substance 2 often has to be added to the reaction mixture 17 during the reaction and the differing external conditions outside the interior of the reaction apparatus 11 are as far as possible to be avoided. In order to achieve an absolutely inert atmosphere, the interior 25 of the reaction apparatus 11, which contains gases or gas mixtures, is often filled, for example, with a chemically inert gas, such as, for example, $N_2$ or argon. This means that, the larger the opening 19 of the reaction vessel 21, the greater the danger that the atmosphere in the reaction vessel 11 will be adversely affected by the atmosphere in the environment of the reaction vessel 21 as a result of the opening of the reaction vessel 21 necessary in order to introduce the container 1.

WO 98/57738 describes reaction apparatuses which make it possible, in a simple manner, for the container 1 to be added, for example, completely automatically under very exact conditions through relatively small openings.

FIG. 5

A container 1 which has not yet been destroyed, is still sealed air-tight and contains a premetered amount of a substance 2 is shown in the reaction mixture 217. This container can now be destroyed in a relatively controled manner at a desired time by switching on the schematically shown magnetic stirrer 15 at a specific frequency. The exact nature of the container 1, i.e. for example its thickness, its material and its design, plays a decisive role in addition to the frequency. The container 1 may be such that it is destroyed or opened on very small movement or only after application of a large force.

Figure 4:
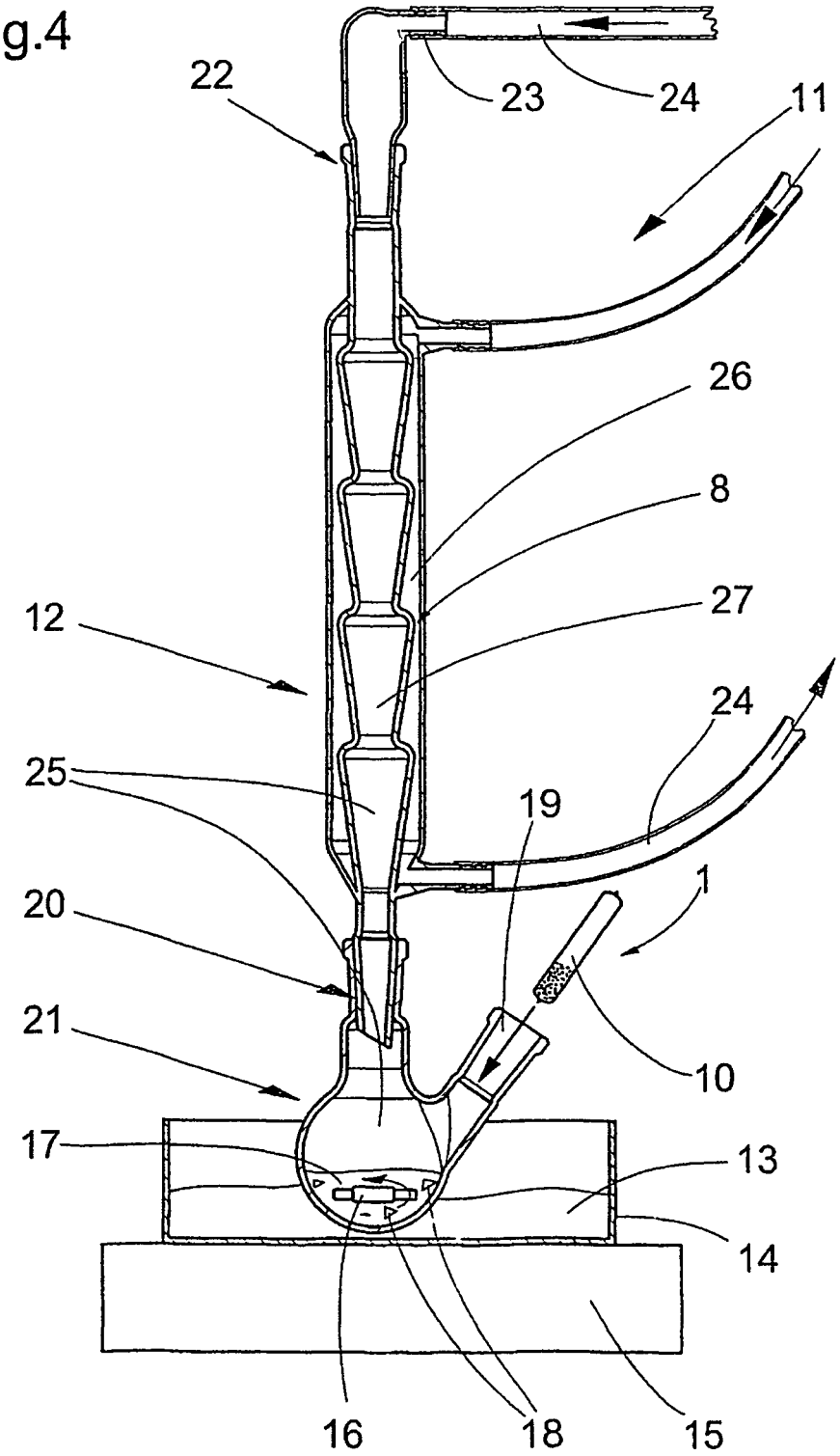
FIG. 4—a sectional view of an apparatus for carrying out a chemical reaction with the aid of containers according to the invention which are destroyed by a rotating magnetic stirrer.

The remainder of the apparatus 11 is the same as in FIG. 4, except that the cooling liquid connecting tubes 24 (cf. FIG. 4) and the argon connection (cf. 23 and 24 in FIG. 4) have not been shown for the sake of clarity.

FIG. 6

The alternative apparatus 111 shown comprises a reflux condenser 112 attached to a reaction vessel 21 and having a reflux condenser cooling liquid space 126 and a reflux condenser interior 127, an oil bath 13 with oil bath container 14, a shaking means 28 shown only schematically, a container 101 sealed air-tight, about to be added to the reaction vessel 21 and containing a premetered substance 102 for carrying out a chemical reaction, a reaction suspension 117 and residues 118 (indicated by a plurality of splitters) of a broken container 101. A first premetered amount of the substance 102 has already been released from the first container 101. A reaction vessel opening 19 is currently open but can be closed by a stopper which has a standard ground glass joint 14.5 and is not shown. The reflux condenser 112 is connected to the reaction vessel 21 via a standard ground glass joint 14.5 120. At the upper end of the reflux condenser is a further standard ground glass joint 14.5 122 which makes it possible to connect an argon line (cf. FIG. 4, reference numerals 23 and 24). In this embodiment, the container 101 is thrown into the open reaction vessel 21 without argon under superatmospheric pressure.

As described, the container 101 has already been added to the reaction vessel 21 and has already been destroyed by shaking by means of the shaking apparatus 28 according to the container stability, and the substance 102 has already been substantially completely released. A further container 101 is added under an argon countercurrent. In this embodiment, the container 101 is destroyed so that it moves in a generally uncontrolled manner in the reaction solution, touches the vessel wall 29 of the reaction vessel 21 once or several times and is broken thereby. Since, in this embodiment, the container 101 consists of relatively thin glass, this happens relatively easily and, depending on the frequency of shaking, with very high reliability. The glass fragments are simply left in the reaction solution, which in this case, as well as in most other cases has at most an insignificant effect on the reaction. Furthermore, the glass fragments are removed at a desired time. However, the most convenient, simplest and safest method is to leave the container residues 118 in the reaction suspension 117 until the latter is worked up, where, as a rule, filtration also has to be carried out for one reason or another. In a completely automatic apparatus, as described in WO 98/57738, even the filtration can be effected at virtually any desired time.

A container 101 filled as a rule under atmospheric pressure can also be introduced into the reaction vessel 21 of the apparatus 111, for example, approximately under atmospheric pressure as described above. If superatmospheric pressure is then applied to the reaction vessel 21, the container bursts by itself at a specific superatmospheric pressure.

FIG. 7

Figure 6:
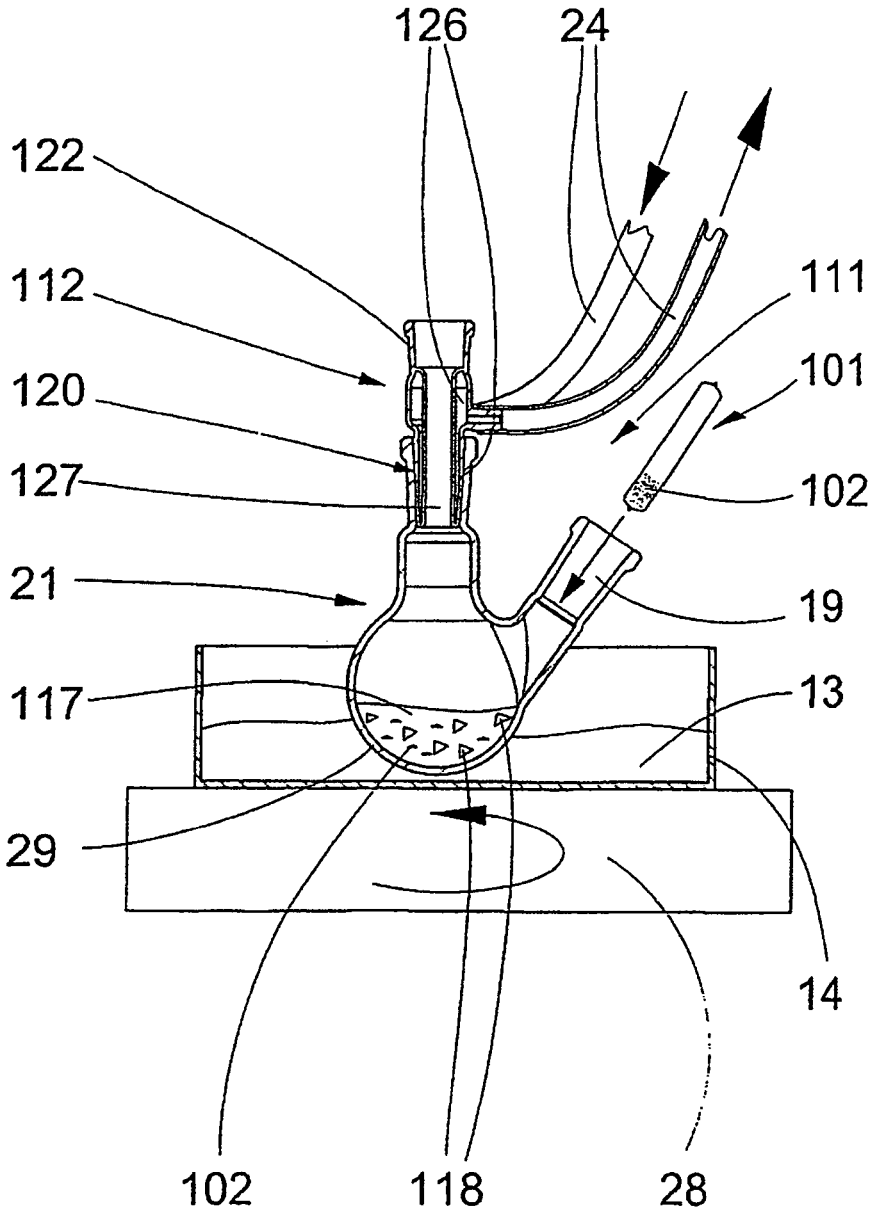
FIG. 6—a sectional view of an alternative apparatus for carrying out a chemical reaction with the aid of containers according to the invention which are destroyed by a rotating magnetic stirrer.
Figure 7:
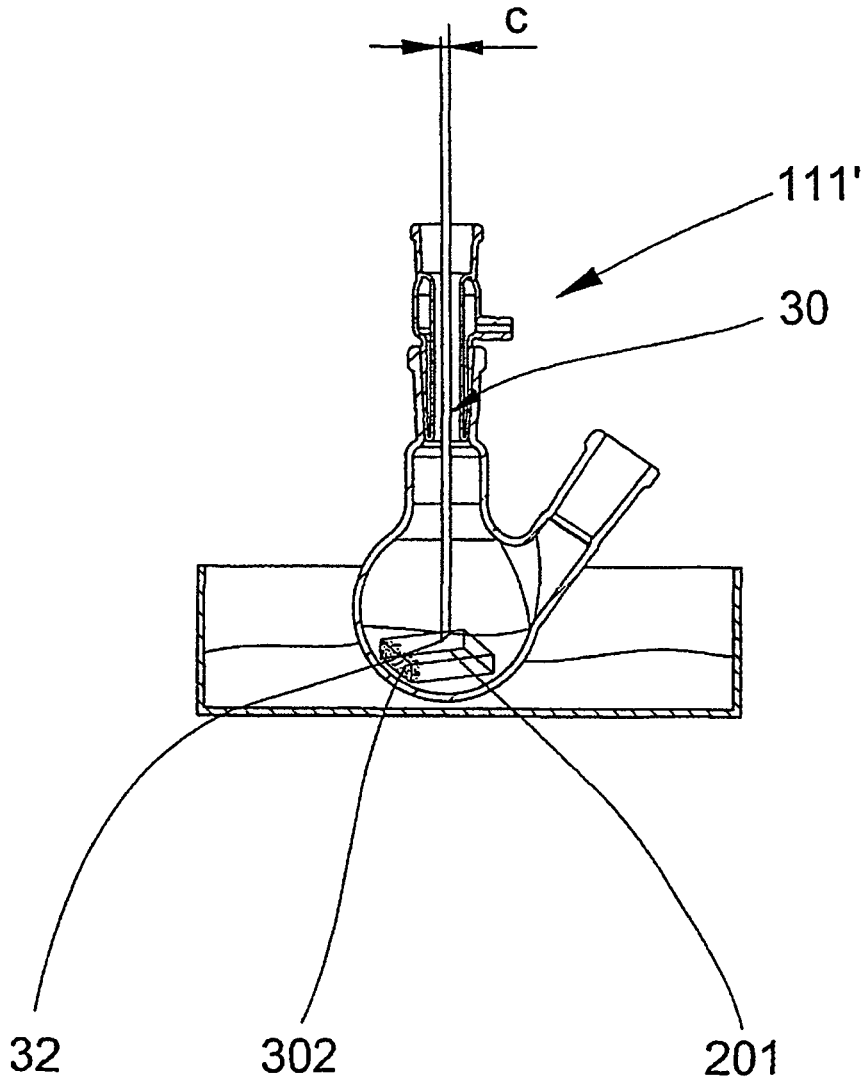
FIG. 7—a sectional view of a further alternative apparatus for carrying out a chemical reaction with the aid of containers according to the invention which are destroyed by means of a needle.

The apparatus 111' corresponds substantially to the apparatus 111 described in FIG. 6, with the exception that, for the sake of clarity, the reflux condenser connecting tubes 24 are not shown. Moreover, no shaking means 28 is present, no second container is added and no residues of a broken container are present. Instead, a container 201 is present and has just being pierced by a needle 30 controlled manually or by a robot, the substance 302 having not yet been released, but the air tightness of the container 201 just having been eliminated. The container 201 has the form of a relatively flat right parallelepiped slightly rounded at the edges and ends for reasons relating to production technology. This form is preferred for the variant shown in this figure and intended for releasing the substance 302 from the container 201, since the needle 30 can thus more easily make contact with the container 201. However, further variants of containers are conceivable, in particular with the use of special needles which have a larger external diameter c and, instead of a needle point 32, a flat lower end.

FIG. 8

The container 301 shown and according to the invention comprises a cylindrical container wall 203 having a wall thickness $b_2$, for example 0.03 mm, a spherical bottom part 204 and a spherical cover part 205. Arranged in the container 301 is a premetered amount of a substance 402, above which a cavity 206 is present. By passing a needle 130 guided manually or by a sampler or robot through a container wall part 34, which in this case is a part of the cover part 205, into the container 301, the latter has just been irreversibly opened. The needle 130 is in the process of feeding a solvent 35 in which the substance 402 will be dissolved.

Figure 8:
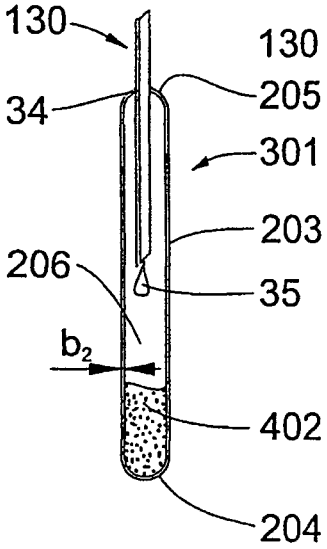
FIG. 8—a longitudinal section of an embodiment of a container according to the invention, of which a container wall has been pierced by a needle, which is just introducing a solvent.
Figure 9:
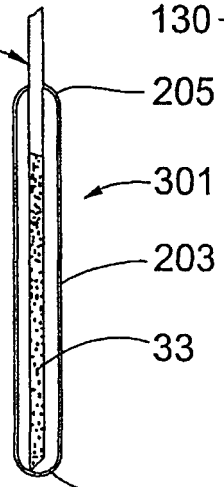
FIG. 9—a longitudinal section of the container and of the needle of FIG. 8, the needle having sucked up the solvent with the substance dissolved therein.

The holder which is necessary to enable the container to be pierced safely and cleanly is not shown. This holder is, for example, integrated in a manual tool or in a robot, for example on the bottom of the robot, as a rule on a rack for holding the containers, in particular in cases where the subsequent procedures described in FIG. 9 and 11 are used. This also means that FIGS. 8, 9 and 11 represent a series of work sequences, while FIGS. 8, 12 and 13 or 8, 9 and 10 each represent an alternative work sequence by means of which a substance in dissolved form, instead of in pure form as in the preceding figures can be metered, for example, into a reaction vessel. The holder of the container 301, which holder is not shown, is preferably integrated at the bottom of the robot in a rack for holding the container in the sequence 8, 12 and 13 as in the sequence 8, 9 and 11, and that in the sequence 8, 9 and 10 is preferably integrated directly in the gripper (in the chamber which receives the container). A holder directly above an opening or a potential opening of the reaction vessel or a holder in the reaction apparatus itself is also conceivable for the last sequence, particularly when absolutely reliable conditions are required during the addition of the dissolved substance. Particularly in the sequence according to FIGS. 8, 9 and 10, the gripper which is not shown or the needle 130 can carry out the entire sequence with the container 301 inside the apparatus, once again particularly when absolutely controlable conditions are required.

The various sequences are described below starting from the situation according to FIG. 8 in association with FIG. 9-13, the sequences themselves not being described completely.

FIG. 9

The solvent 35 has already dissolved the substance 402 and the needle 130 has completely sucked up the solution 33 thus formed. In the present context, the expression "solution" also includes suspensions, emulsions, a mixture of a liquid and solid particles which are suspended, for example, by prior shaking, i.e. are in a state of nonequilibrium, etc. For safe and better preparation of a solution, the solution 33 or a part thereof can be discharged again and sucked up again, possibly even several times. Various options are thus available.

FIG. 10

The needle 130 has pierced the bottom part 204 opposite the piercing hole 38 and is now again releasing the aspirated solution 33, for example into a reaction apparatus, a reaction vessel or an intermediate container.

FIG. 11

Figure 10:
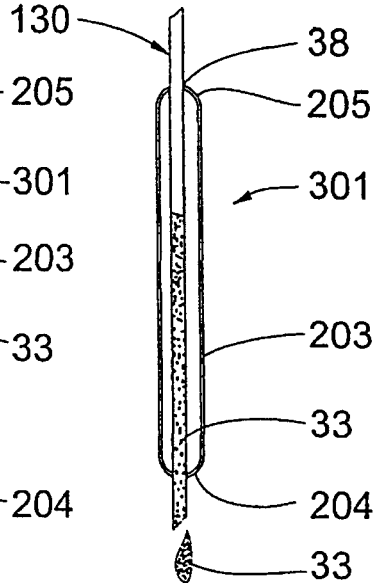
FIG. 10—a longitudinal section of the container and of the needle of FIG. 8, the needle having pierced the container wall part opposite the piercing site and releasing the solution with the substance.
Figure 11:
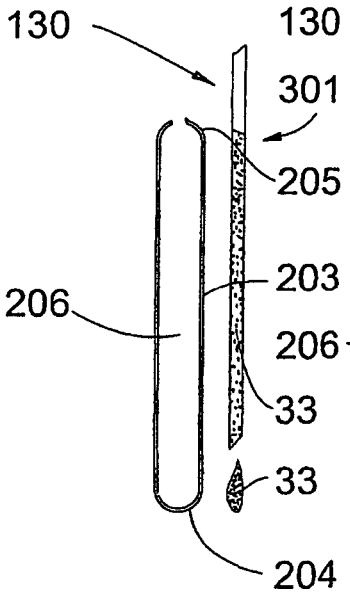
FIG. 11—a longitudinal section of the container and of the needle of FIG. 8, the needle once again having been withdrawn from the container and releasing the solution with the substance next to said container, as an alternative to the variant shown in FIG. 10.

As an alternative to the method step shown in FIG. 10, the needle 130 with the aspirated solution 33 has been withdrawn here from the container 301 and now releases the solution 33 substantially completely in another location or in aliquots at a plurality of other locations. The container can be held, for example, in a robot arm and then ejected or simply held in a rack. The substantially completely empty container is then as a rule discarded.

FIG. 12

In this variant, the needle 130 guided, for example, by a robot has pierced the bottom part 204 opposite the piercing site by a simple downward movement after the formation of the solution 33 by dissolution of the substance 402.

FIG. 13

Figure 12:
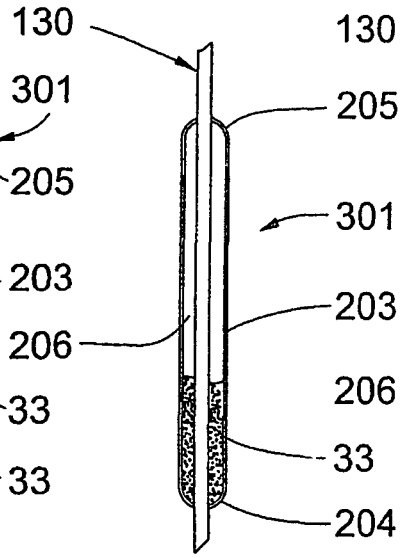
FIG. 12—a longitudinal section of the container and of the needle of FIG. 8, the needle having pierced the container wall part opposite the piercing site without previously sucking up the solvent with the substance dissolved therein, as an alternative to the variants shown in FIG. 9-11.
Figure 13:
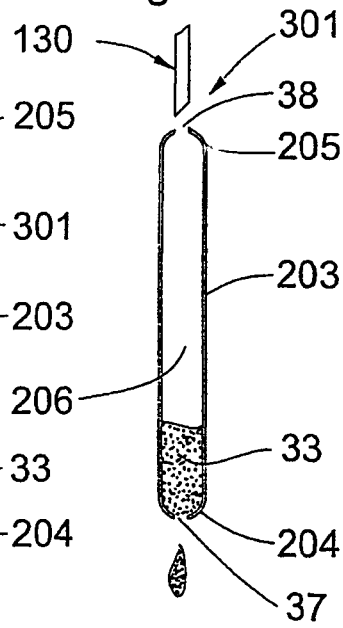
FIG. 13—a longitudinal section of the container and of the needle of FIG. 12 after the needle has been withdrawn from the container.

Starting from the situation shown in FIG. 12, the needle 130 is withdrawn from the container 301 manually or under control by a robot. This not only leaves behind an outward piercing hole 37 in the bottom part 204 but also a piercing hole 38 in the cover part 204, automatically ensuring pressure equalization in the container when the solution 33 runs out.

FIG. 14

In this embodiment, the container 401 according to the invention and sealed air-tight contains a premetered amount of a substance 302. It comprises a cylindrical hollow body 303 which is closed at the bottom by a partly spherical bottom 304 provided with a fused tip and at the top by a partly spherical cover 305 provided with a fused tip. With the exception of the bottom region and cover region, the cylindrical hollow body 303 has the same diameter everywhere. The wall thickness $b_3$ of the cylindrical hollow body 303 is small, for example 0.04 mm, in particular relative to the external diameter, which is, for example, 4 mm. The cavity 306 is as a rule filled with air under atmospheric pressure or, in the case of sensitive substances 302 or generally advantageously, with nitrogen or, more advantageously with argon.

Otherwise, the statements made in connection with FIG. 1 are substantially applicable.

FIG. 15.1 to 15.4

Figure 14:
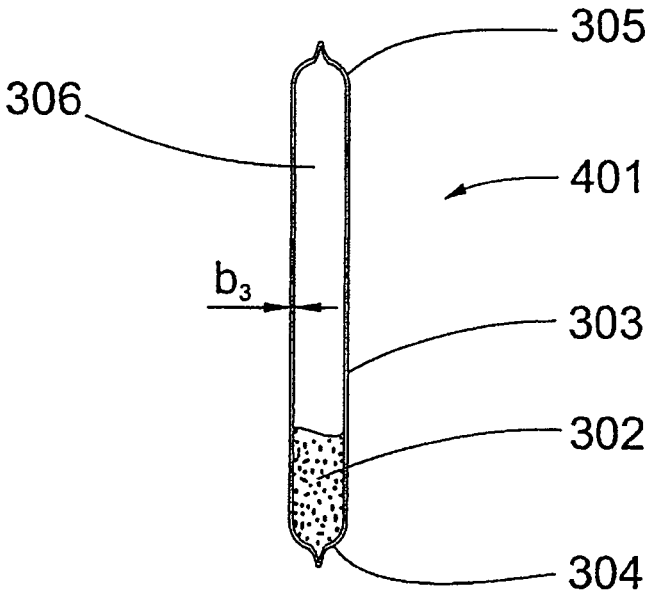
FIG. 14—a longitudinal section of an alternative embodiment of a container according to the invention which has been sealed air-tight and contains a premetered amount of substance.
Figure 15:
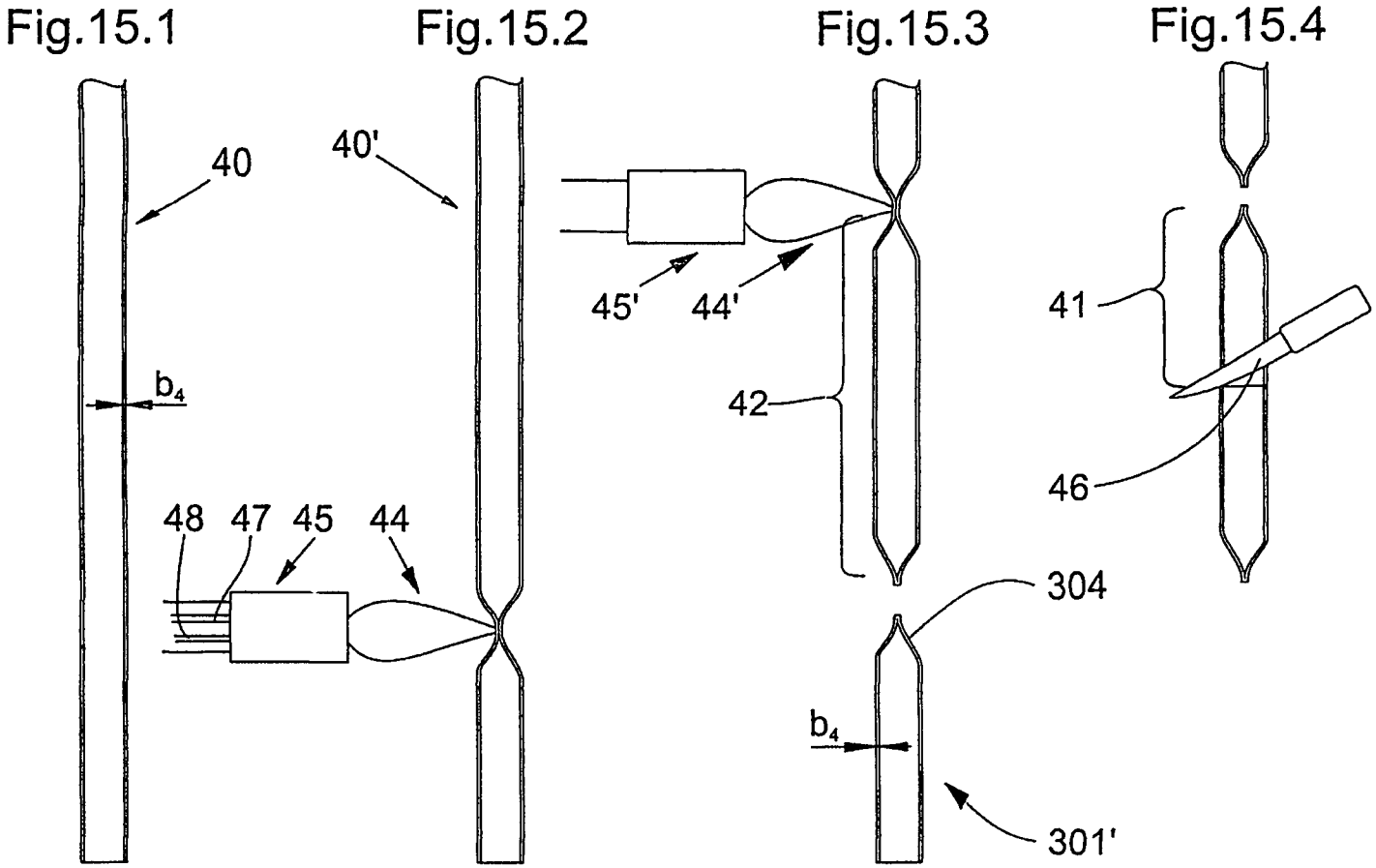
FIG. 15.1 to 15.4—the production of container blanks for containers according to FIG. 14 in various steps of the method.

FIGS. 15.1 to 15.4 show the production of container blanks for containers according to FIG. 14 in various steps of the method. Shown in FIG. 15.1, the procedure starts from a relatively thin-walled glass cylinder 40 open at the top and bottom and having a wall thickness $b_4$, for example 0.05 mm.

According to FIG. 15.2, the glass cylinder 40 is sealed by fusion at a certain point by means of a highly concentrated flame 44 which is in the form of a fine jet, produced by a flame thrower 45 and guided and controled manually or by a robot (not shown). The flame 44 is produced by combustion of a conventional gas which is fed via lines 47, 48. Thus, on the one hand an open container blank 301' having bottom part 304 according to FIG. 15.3 and, on the other hand, a hollow glass cylinder 40' which is closed at the bottom and is shorter by about the length of the blank 301' are formed.

In the next step, as shown in FIG. 15.3, a lower part 42, which is about twice as long as the container, is separated from the glass cylinder 40' by means of a flame 44' which is produced by a flame thrower 45'. The flame thrower 45' may be the same as the flame thrower 45. Further lower parts 42 can be separated from the remaining glass cylinder part.

As shown in FIG. 15.4, the lower part 42 is then halved by means of a diamond cutter 46, resulting in two container blanks 41 open at one end and corresponding to the container blank 301'.

FIG. 16

Figure 2:
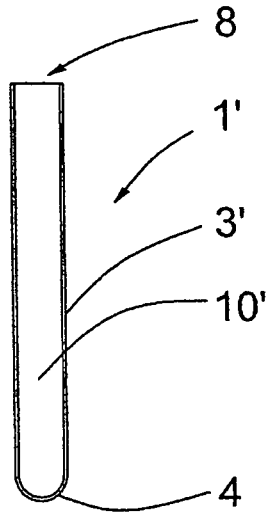
FIG. 2—a longitudinal section of the container of FIG. 1 before it has been filled with the substance and has been sealed air-tight.
Figure 3:
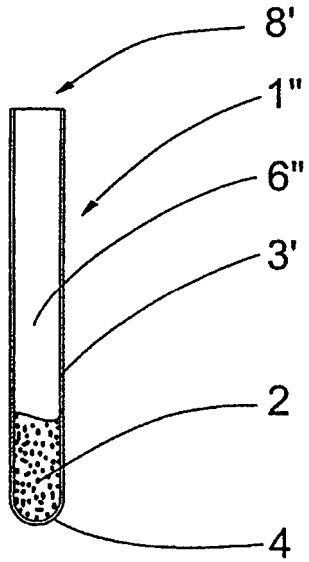
FIG. 3—a longitudinal section of the container of FIG. 2 after the substance has been introduced.

For filling and sealing container blanks according to FIG. 2, in the embodiment shown the blanks 1', 1'', 1''', etc. are held in holes 63 of a support 61. In each case an exactly premetered amount of a substance 402', 402", etc. is introduced into the blanks 1', 1", 1'", etc. The filled blanks 1', 1", 1'", etc. are then sealed by fusion by means of a melting apparatus 60 guided manually or by a robot 62, which is shown schematically by the spatial axes, to give in each case an air-tight container 1 according to FIG. 1.

FIG. 17

For filling and sealing container blanks according to FIG. 2, in this alternative embodiment the blanks 1', 1", 1'", etc. are held in holes 67 of a support 65. In each case an exactly premetered amount of a substance 502', 502", etc. is introduced into the blanks 1', 1", 1'", etc. The filled blanks 1', 1", 1'", etc. are then sealed by fusion by means of a melting apparatus 64 guided manually or by a robot 66, shown schematically by the spatial axes to give in each case an air-tight container 1 according to FIG. 1 which is filled with substance 502.

Figure 16:
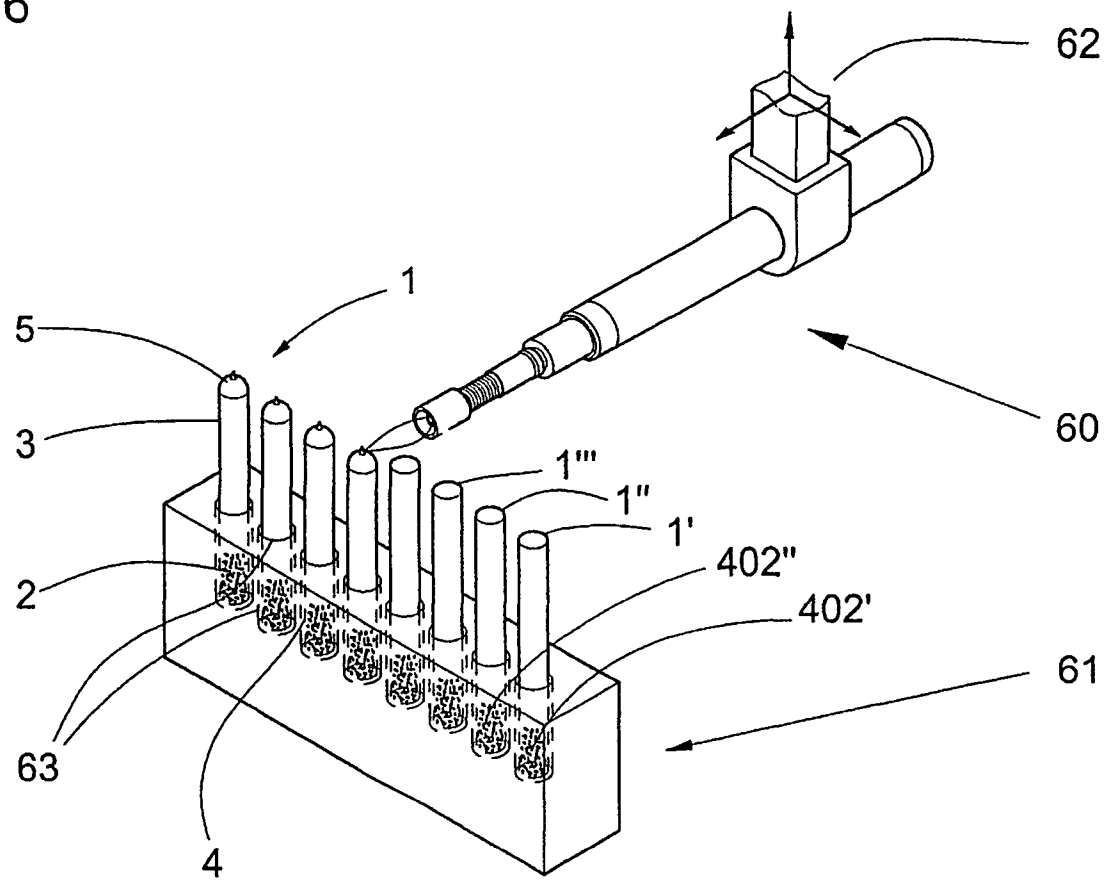
FIG. 16—a perspective view of a part of an apparatus which is guided manually or by a robot and with which containers filled with the premetered amount of a substance are sealed air-tight by fusion.

In contrast to the embodiment shown in FIG. 16, the sealing of the container blanks is effected here under a transparent cube 68, for example made of Plexiglas or polycarbonate. The free space in the cube 68 is completely filled with a chemically relatively inert gas, e.g. nitrogen, even more advantageously a noble gas, e.g. argon, with the result that that space in the container 1 sealed air-tight which is not occupied by the premetered substance 502 is finally likewise filled with this chemically relatively inert gas.

There are also other variants, which are not shown, for ensuring that the containers 1 are finally filled with a chemically relatively inert gas in addition to the desired substance. For example, argon, which is heavier than air and accordingly accumulates on the substance, can be blown into the blanks 1', 1", 1'", etc., for example via a needle which is mounted in the melting apparatus 60 or 64 and fastened to a gas line, shortly before the sealing by fusion and possibly also during said sealing.

Figure 17:
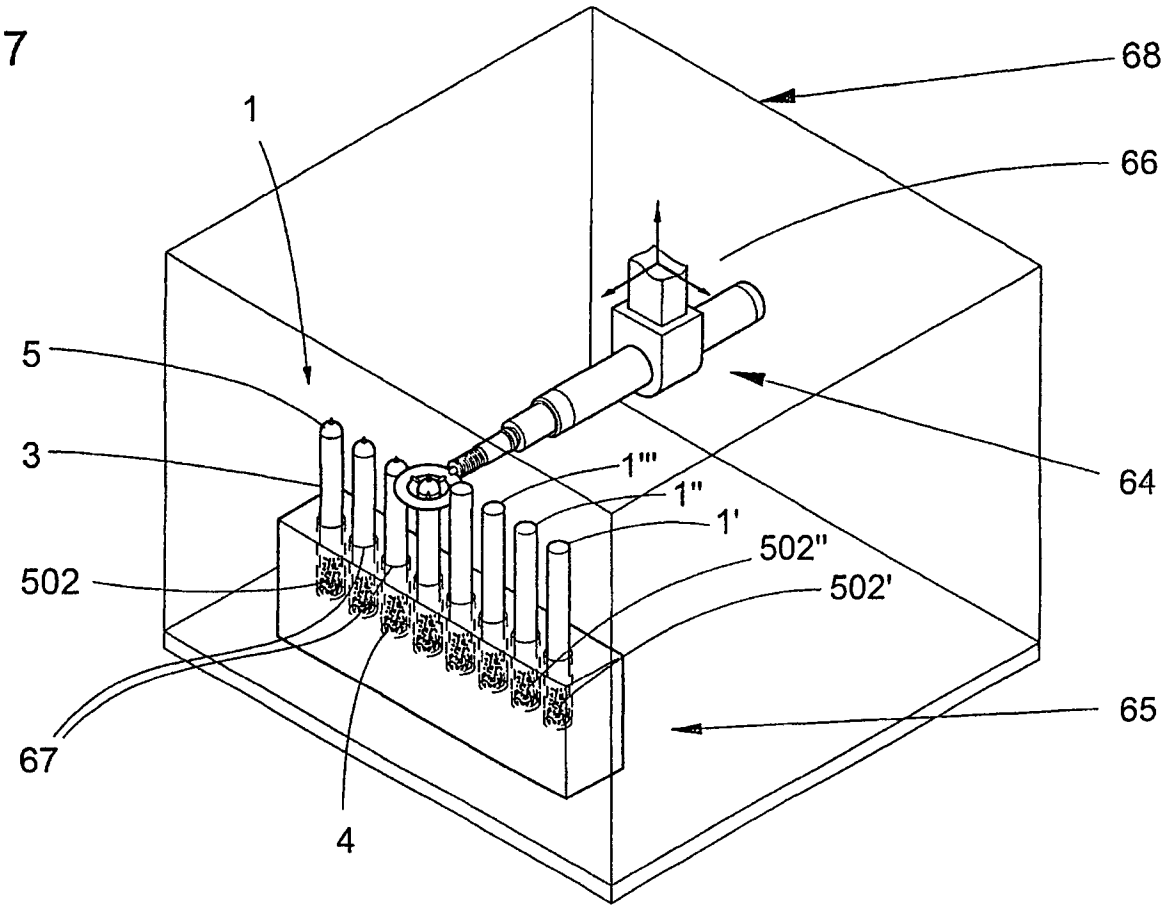
FIG. 17—a perspective view of a part of an alternative apparatus which is guided manually or by a robot and with which containers filled with a premetered amount of a substance are sealed air-tight under an inert atmosphere by fusion.

The variant shown in FIG. 17 and using a chemically relatively inert gas under a cube 68 has the disadvantage that, as a rule, more gas is required, but has the often decisive advantage that, for example, substances 502', 502", etc. which undergo spontaneous ignition with air or with the oxygen contained therein or substances 502', 502", etc. which are sensitive to hydrolysis can be filled safely and with preservation of the quality of the substances.

FIG. 18

Containers 1 containing eight substances 602, 702, etc. are held here in holes 71 in a support 70. During the filling of the blanks 1', 1", 1'", etc., as shown in FIG. 16 and 17, however, it is advantageously, but not necessarily always the same substance which is filled per support or per group of supports, and advantageously though not necessarily filling is effected always in the same premetered amount, since this substantially simplifies and speeds up the filling procedure, particularly when it is fully automated. These supports are then stored and are removed from storage when required, for example by a commercially available laboratory robot, to form a set 69 of containers 1 with different substances 602, 702, etc. For certain applications, it is advantageous to use racks of identical substances, not necessarily in the same premetered amounts. In this case, different supports actually form a set of containers with different substances.

FIG. 19

Figure 18:
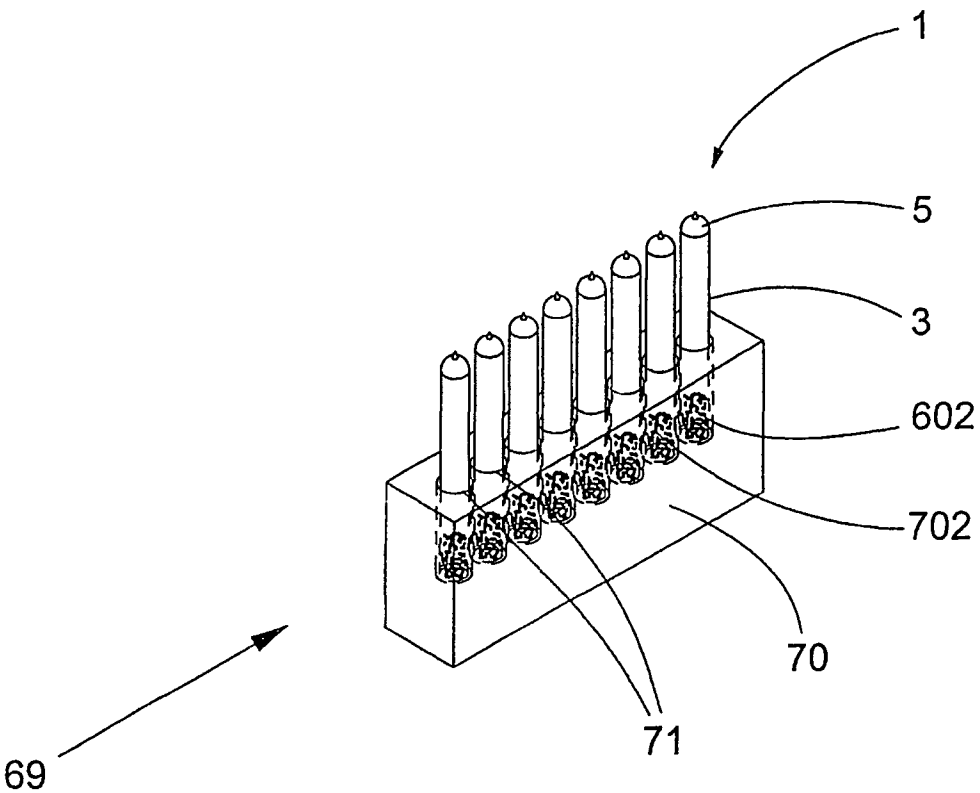
FIG. 18—a perspective view of an embodiment of a set according to the invention of containers containing 8 substances and held in a support.
Figure 19:
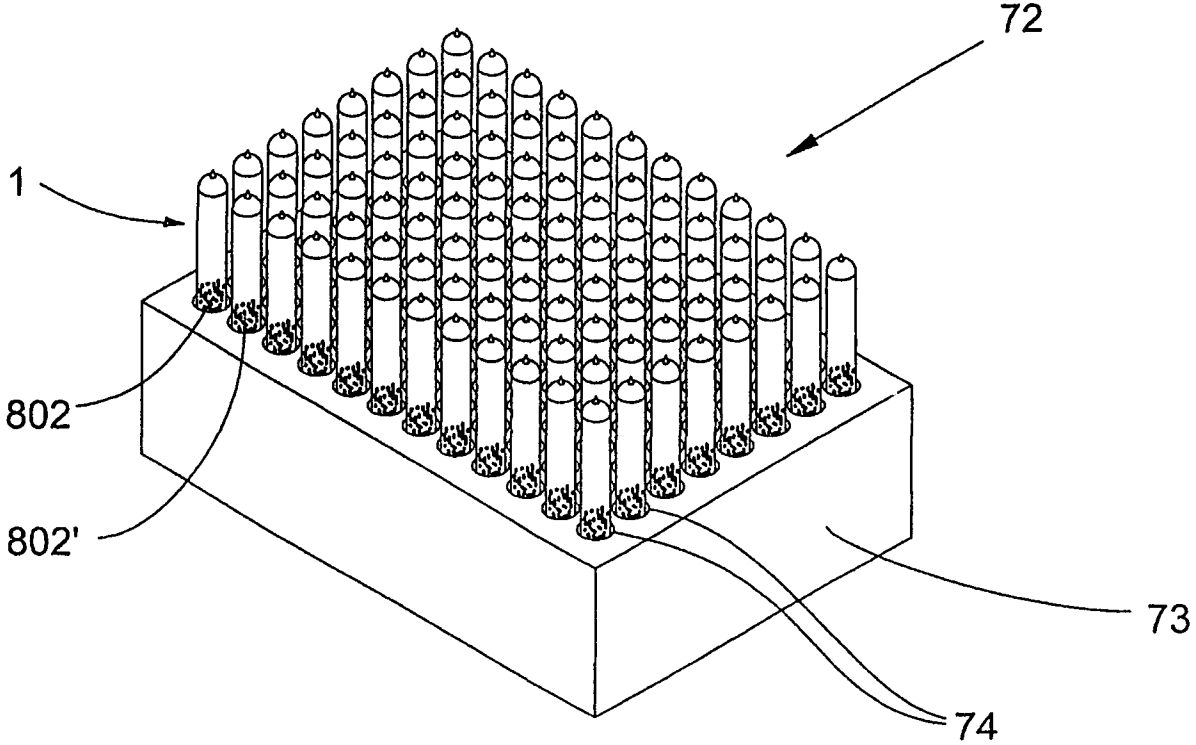
FIG. 19—a perspective view of an alternative embodiment of a set according to the invention of containers containing 96 substances and held in a support.

The alternative set 72 shown here comprises 96 containers 1 which contain substances 802, 802', etc. and are held in holes 74 in a support 73. Furthermore, the statements made in connection with FIG. 18 are applicable.

FIG. 20

An alternative embodiment of a container 501 according to the invention which is sealed air-tight and contains a premetered amount of substance 902 has the form of a right parallelepiped 403 having a relatively small wall thickness $b_5$, e.g. 0.02 mm, an internal volume 406 which is not occupied by the substance 402, a cover part 405 and a bottom part 404.

FIG. 21

In this alternative embodiment, the container 601 according to the invention which is sealed air-tight and contains a premetered amount of a substance 1002 has the form of a sphere 503 having a relatively small wall thickness $b_6$, e.g. 0.03 mm. This embodiment too is comparable with the container 1 described in FIG. 1 with respect to convenience of use, even if, on comparison of the smallest cross section, the volume is substantially smaller than in the case of the cylindrical container 1 of FIG. 1 and hence the maximum premeterable amount of substance 1002 is smaller.

For certain applications, in particular in the nanomolar range, however, this container 601 has decisive advantages. For example, it may also be "pseudoflowable", for example metered through pipes having a pipe diameter which corresponds, for example, to four times the sphere diameter, directly into a reaction vessel, particularly if a large number of identical containers 601 are used for each reaction and the total amount of substance is measured "quasivolumetrically". Although the accuracy suffers, this need not necessarily be relevant in the case of a large number of spheres, but the speed is increased considerably. In addition, the accuracy can be brought back to a high level by commercially available optical detection or counting systems.

FIG. 22

In this alternative embodiment, the container 701 according to the invention which is sealed air-tight and contains a premetered amount of a substance 1102 comprises a cylindrical hollow body 603 which has a wall thickness $b_7$, e.g. 0.5 mm, and is closed at the bottom by a spherical bottom 504 and at the top by a partly spherical cover 505 provided with a fused tip. The cavity above the substance 1102 is denoted by 506. In the middle of the container 701, the cylindrical hollow body 603 has a constriction 76 and a slightly smaller container wall thickness and hence a predetermined breaking point 75.

FIG. 23

In this alternative embodiment, the container 801 according to the invention which is sealed air-tight and contains a premetered amount of a substance 1202 comprises a cylindrical hollow body 703 which has a small wall thickness $b_8$, e.g. 0.04 mm, and is sealed air-tight at the bottom by a spherical bottom 604 and at the top by a partly spherical cover 605 provided with a fused tip. The cavity above the substance 1202 is denoted by 606. The cylindrical hollow body 703 is provided on the outside with a bar code 77 for identification of the substance 1202 present in the container, the amount of said substance, its quality, etc. Here, the bar code 77 is scored into the glass container wall, which has the advantage that there is no need to use any additional material, which would once again have to be chemically inert, depending on the application.

FIG. 24

In this alternative embodiment, the container 901 according to the invention which is sealed air-tight and contains a premetered amount of a substance 1302 comprises a cylindrical hollow body 803 which has a small wall thickness $b_9$, e.g. 0.02 mm and is sealed air-tight at the bottom by a spherical bottom 704 and at the top by a partly spherical cover 705 provided with a fused tip. The cylindrical hollow body 803 is provided on the outside with a chemical formula 78 for identification of the substance 1302 present in the container. Here, the chemical formula 78 is scored into the glass container wall, which has the advantage that there is no need to use any additional material, which would once again have to be chemically inert, depending on the application.

Figures 20, 21, 22, 23, 24:
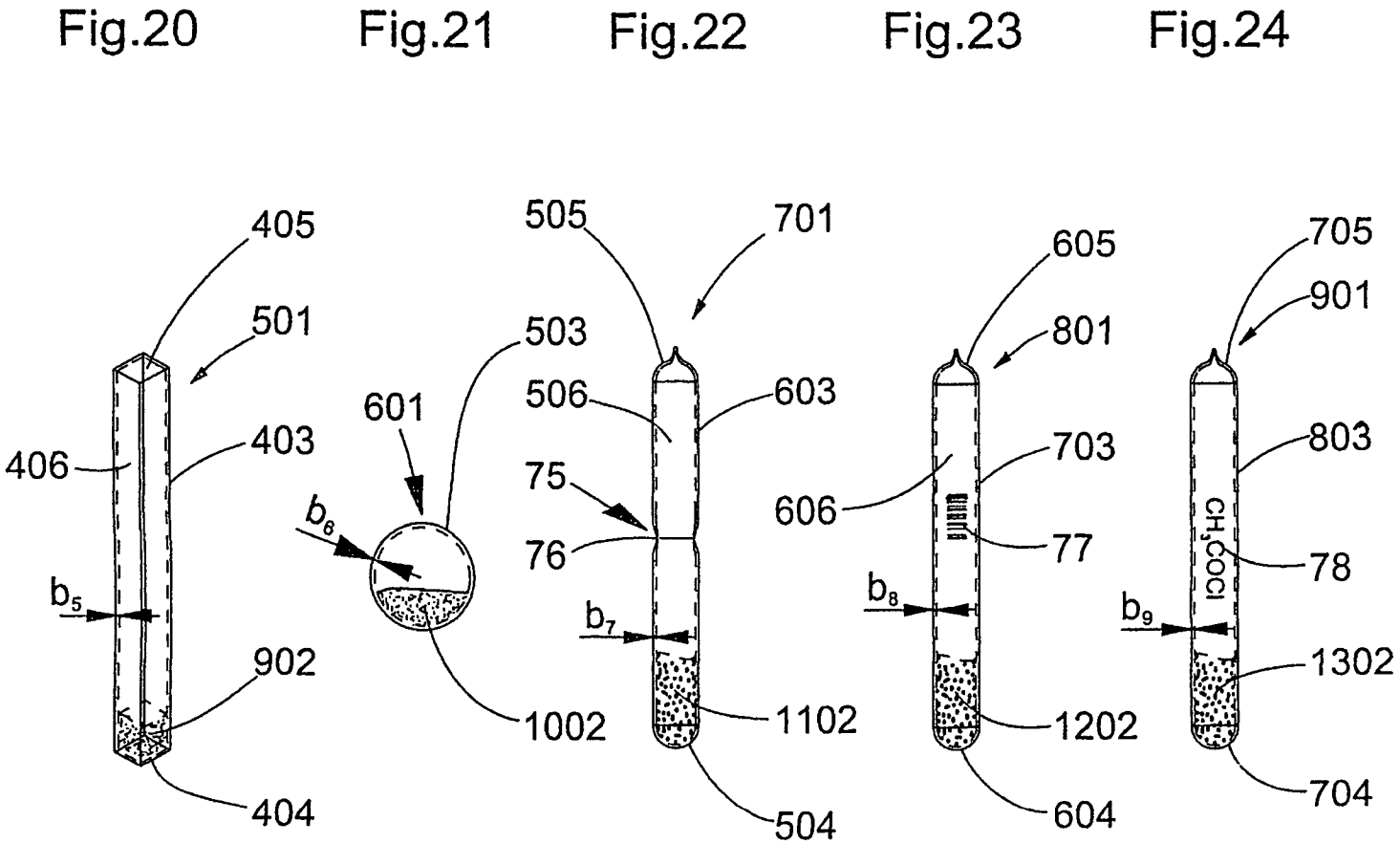
FIG. 20—a perspective view of an alternative embodiment of a container according to the invention which is sealed air-tight and is in the form of a right parallelepiped.
FIG. 21—a sectional view of an alternative embodiment of a container according to the invention which is sealed air-tight and is in the form of a sphere.
FIG. 22—a longitudinal section of an alternative embodiment of a container according to the invention which is sealed air-tight and is in the form of a cylinder which has a predetermined breaking point in the middle.
FIG. 23—a longitudinal section of an alternative embodiment of a container according to the invention which is sealed air-tight and is in the form of a cylinder which is provided with a bar code on the outside.
FIG. 24—a longitudinal section of an alternative embodiment of a container according to the invention which is sealed air-tight and is in the form of a cylinder which is provided with a chemical formula on the outside.
Figure 26:
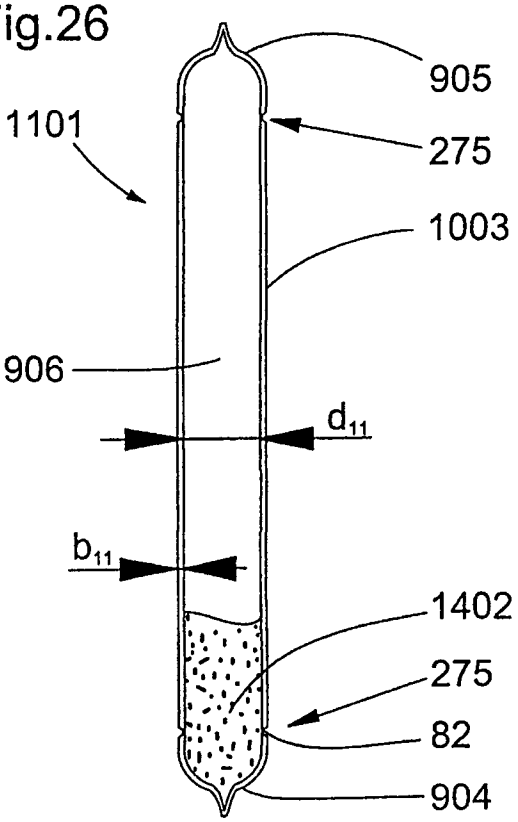
FIG. 26—a longitudinal section of an alternative embodiment of a container according to the invention which is sealed air-tight and has two predetermined breaking points.
Figure 25:
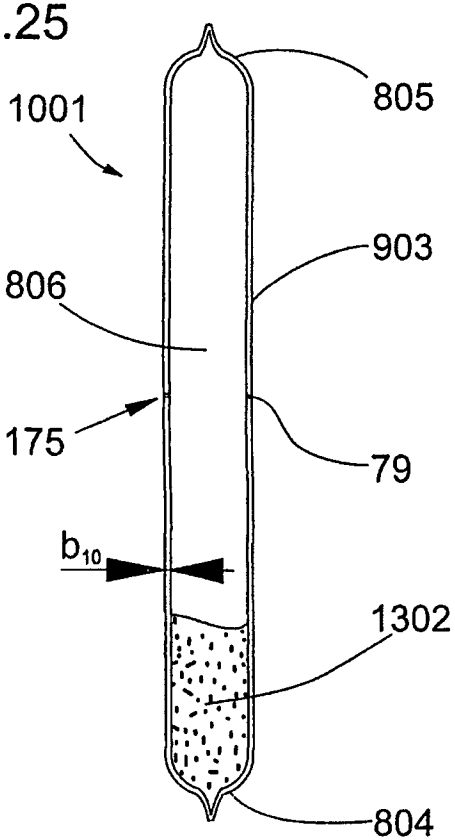
FIG. 25—a longitudinal section of an alternative embodiment of a container according to the invention which is sealed air-tight and is in the form of a cylinder which is glued together in the middle.

It is particularly advantageous to provide a container both with a bar code 77 as shown in FIG. 23 and with the chemical formula 78, since this provides the user with, on the one hand, a designation having a meaning known to him and, on the other hand, a bar code which can be loaded with much more information but which, in contrast to the chemical formula, cannot as a rule be read by the user without an aid.

FIG. 25

In this embodiment, the container 1001 according to the invention and sealed air-tight contains a premetered amount of a substance 1302 and, above this, a cavity 806. It comprises a cylindrical hollow body 903 which has a wall thickness $b_{10}$, e.g. 0.5 mm, and is sealed air-tight at the bottom by a partly spherical bottom 804 provided with a fused tip and at the top by a partly spherical cover 805 provided with a fused tip. At a predetermined breaking point 175 approximately in the middle of the container 101, the latter has an adhesive bond 79 between two container parts, which adhesive bond can be dissolved, for example, by a solvent or a reaction mixture so that the container is opened.

FIG. 26

In this embodiment, the container 1101 according to the invention and sealed air-tight contains a premetered amount of a substance 1402 and, above this, a cavity 906. It comprises a cylindrical hollow body 1003 which has a diameter $d_{11}$, e.g. 4 mm and a wall thickness $b_{11}$, e.g. 0.5 mm and is sealed air-tight at the bottom by a partly spherical bottom 904 provided with a fused tip and at the top by a partly spherical cover 905 provided with a fused tip. In the vicinity of the cover 905 and of the bottom 904, the cylindrical hollow body 1003 has in each case a constriction 82 and a slightly smaller container wall thickness and hence in each case a predetermined breaking point 275.

Compared with the embodiment shown in FIG. 22, this embodiment has the advantage that the substance 1402 can be released more rapidly from the container. Particularly when the substance is removed by dissolving with the aid of a solvent, problems can occur in the case of the container 701 of FIG. 22 in that, particularly at small internal diameters of the cylinder, capillary effects may occur and a local reduced pressure retards or even prevents further outflow of liquid or dissolved substances. This disadvantage is greatly reduced with the container 1101 since this is opened at two predetermined breaking points 275.

Containers having even more predetermined breaking points have also been produced. In the case of glass, the simplest method of producing them is to score the desired point (over a specific angle or all around) by means of a diamond cutter.

Figure 27:
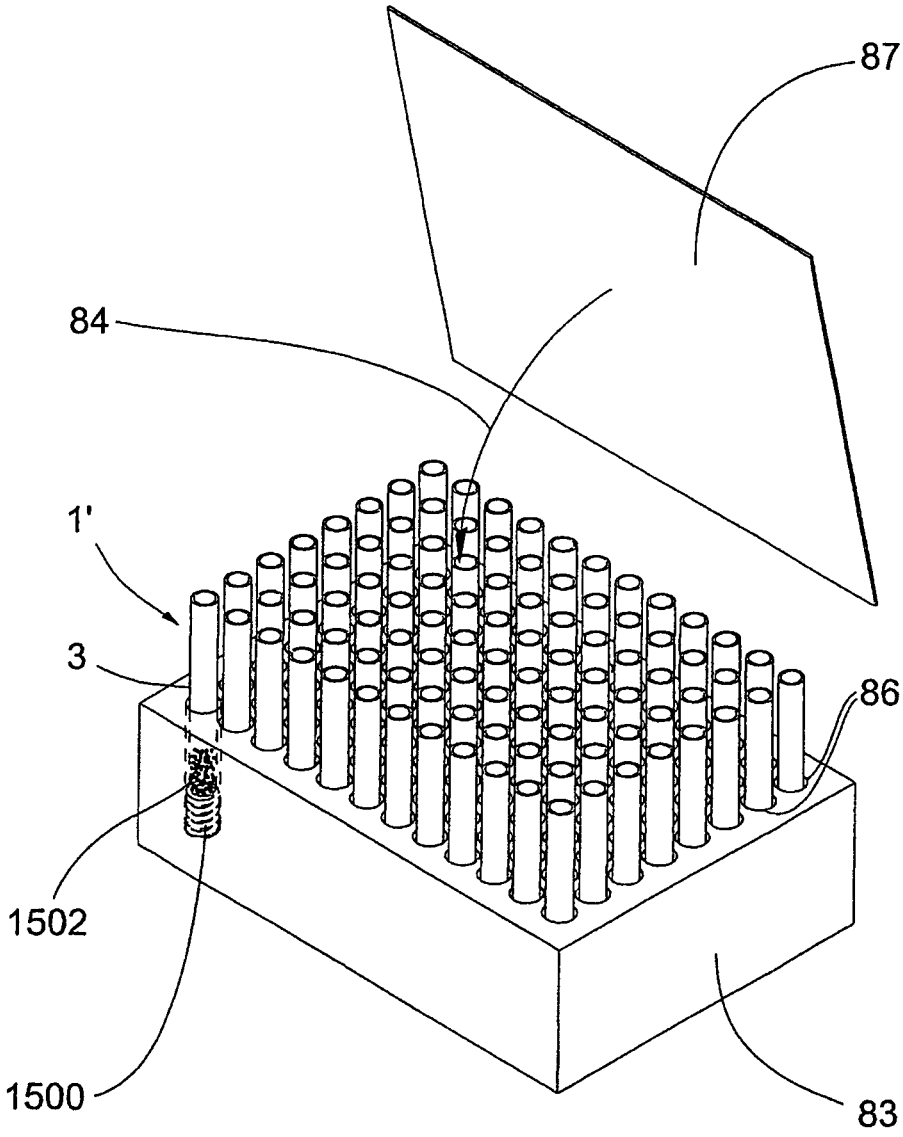
FIG. 27—a perspective view of 96 container blanks which are held in a rack and filled with one premetered amount each of a substance and are covered by a thin glass plate.
Figure 29:
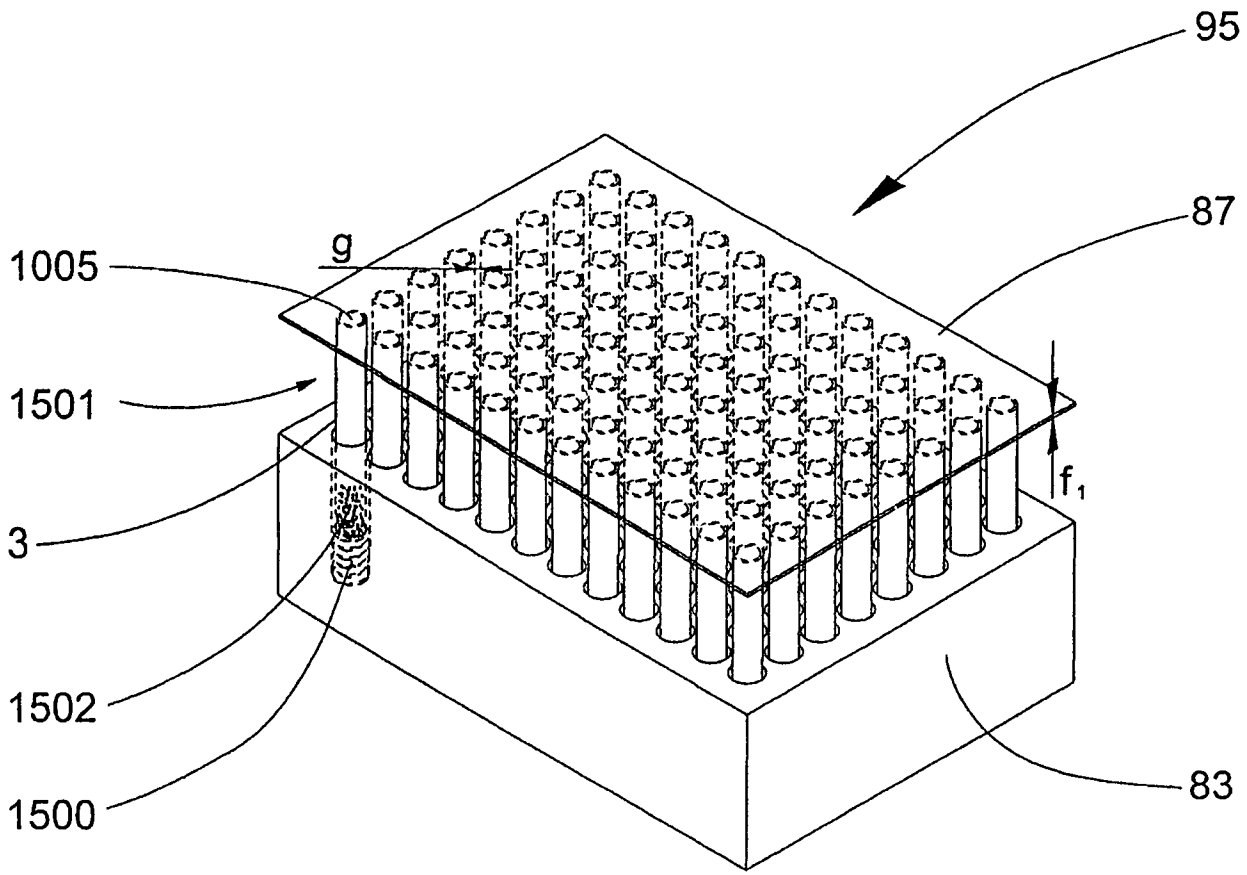
FIG. 29—a perspective view of the set or kit of containers containing 96 substances which is obtained according to FIG. 27, 28 and 28.1.
Figure 30:
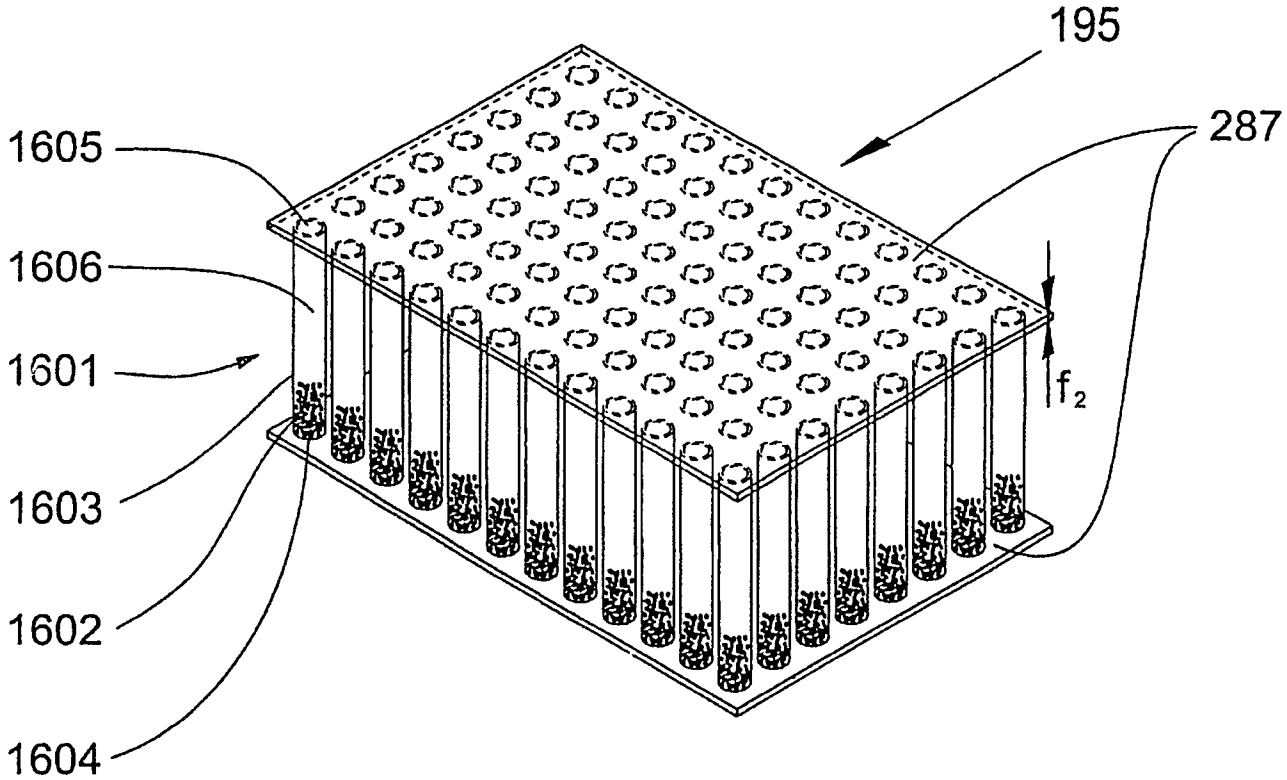
FIG. 30—a perspective view of an alternative embodiment of a set or kit, according to the invention, of containers containing 96 substances and having an upper and a lower thin glass plate.

FIGS. 27 to 29

FIG. 27, 28 and 28.1 show the production of a set 95 or kit, according to the invention, of 96 containers 1501 according to FIG. 29, containing substances.

According to FIG. 27, first 96 blanks 1' comprising a cylindrical hollow body 3 are arranged above springs 1500 in holes 86 of a rack 83 and are each filled with a premetered amount of a substance 1502. A relatively thin glass plate 87 covering all blanks 1' is then placed on the open side of the blanks 1' in accordance with arrow 84. The springs 1500 ensure that all blanks 1' rest against the glass plate 87.

A thicker, heat-insulating and fireproof plate 88 which has annular holes 89 exactly in the areas under which the edges of the blanks 1' of the containers 1501 with the premetered substances 1502 are present is then placed on the glass plate 87, according to FIGS. 28 and 28.1. The annular holes 89 have the same external diameter $e_1$ and the same internal diameter $e_2$ as the blanks 1' of the containers 1501. The heat-insulating and fireproof cores in the holes 89 are held by wire-like connections 90. Heat is then generated by an apparatus 2000 producing 96 flames 2001 and is delivered through the annular holes 89 to the glass plate 87, with the result that the blanks 1' of the containers 1501 are fused at their upper edge to the glass plate 87.

The procedure described gives the set according to the invention, which set is shown in FIG. 29 and comprises 96 containers 1501 containing premetered substances, or a corresponding kit which comprises 96 containers containing identical substances and which, together with at least one further container with another substance, forms a set, according to the invention, of containers containing substances. Individual containers 1501 can easily be broken out of this set 96. Depending on the thickness $f_1$ of the glass plate 87, the resulting cover 1005 of an individual container 1501 forms a predetermined breaking point or zone, particularly if the wall thickness g of the cylindrical part 3 of the container 1501 is significantly greater.

As an alternative to fusing the glass plate 87 onto the blanks 1' of the containers 1501, adhesive bonding is also conceivable.

FIG. 30

In this alternative embodiment of a set 195 according to the invention or of a kit, the 96 containers 1601 sealed air-tight each comprise a premetered amount of a substance 1602, a cylindrical hollow body 1603, a cover 1605 and a bottom 1604. The cavity above the substance 1602 is denoted by 1606. The cover 1605 and the bottom 1604 are formed by fusing on or bonding on one thin glass plate 287 each at the bottom and top of the container blanks. In this set 195, the containers 1601 sealed air-tight and each containing a premetered substance 1602 are held together by two plates 287 and can easily be broken out. Depending on the thickness $f_2$ of the glass plates 287, the cover 1605 and the bottom 1604 of an individual container 1601 form a predetermined breaking point or zone.

Figures 31, 32, 33:
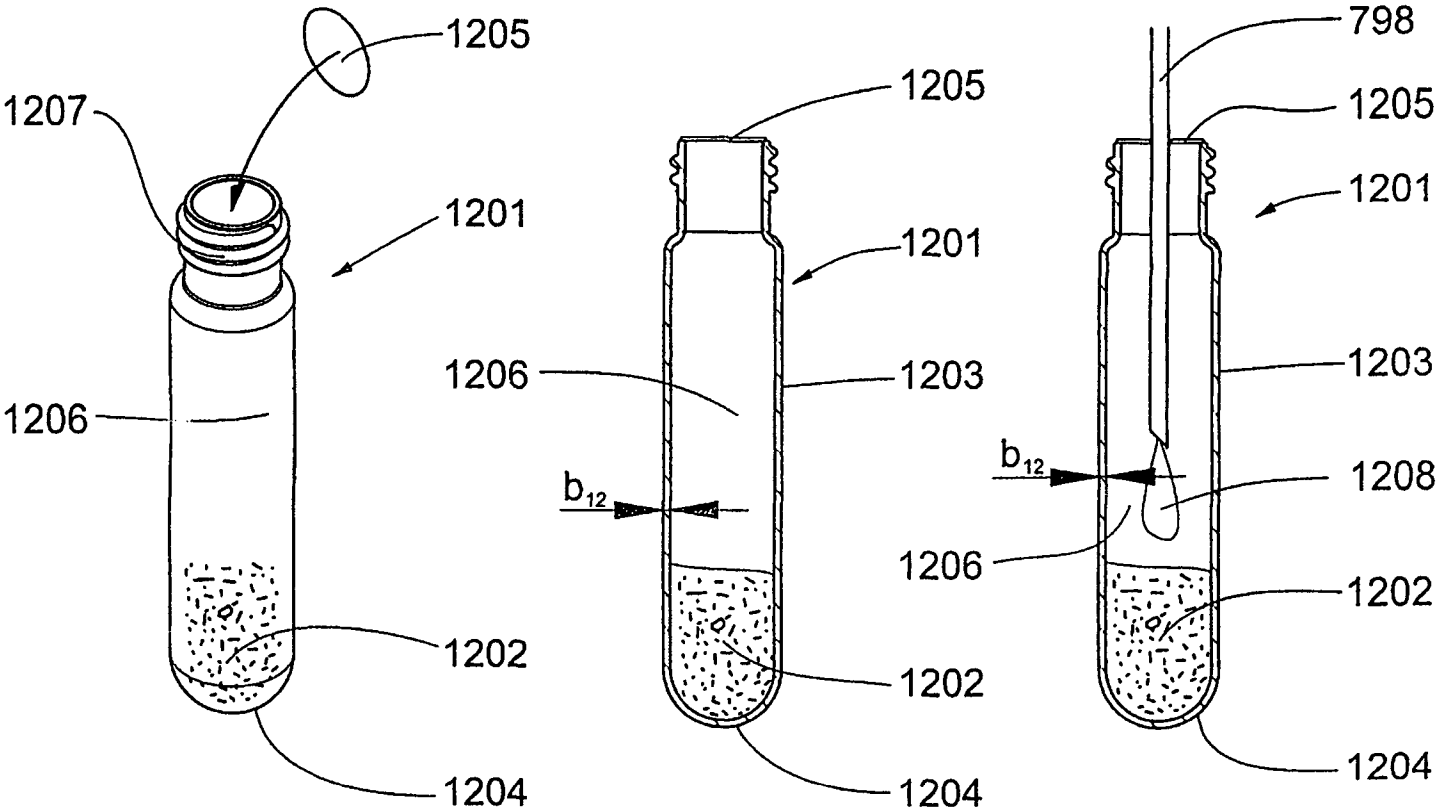
FIG. 31—a perspective view of an alternative embodiment of a container according to the invention which is to be sealed by welding on a thin cover.
FIG. 32—a longitudinal section of the container of FIG. 31 in the sealed state.
FIG. 33—a longitudinal section of the sealed container of FIG. 32 which has been pierced by a needle which adds solvent for dissolving the substance.
Figure 34:
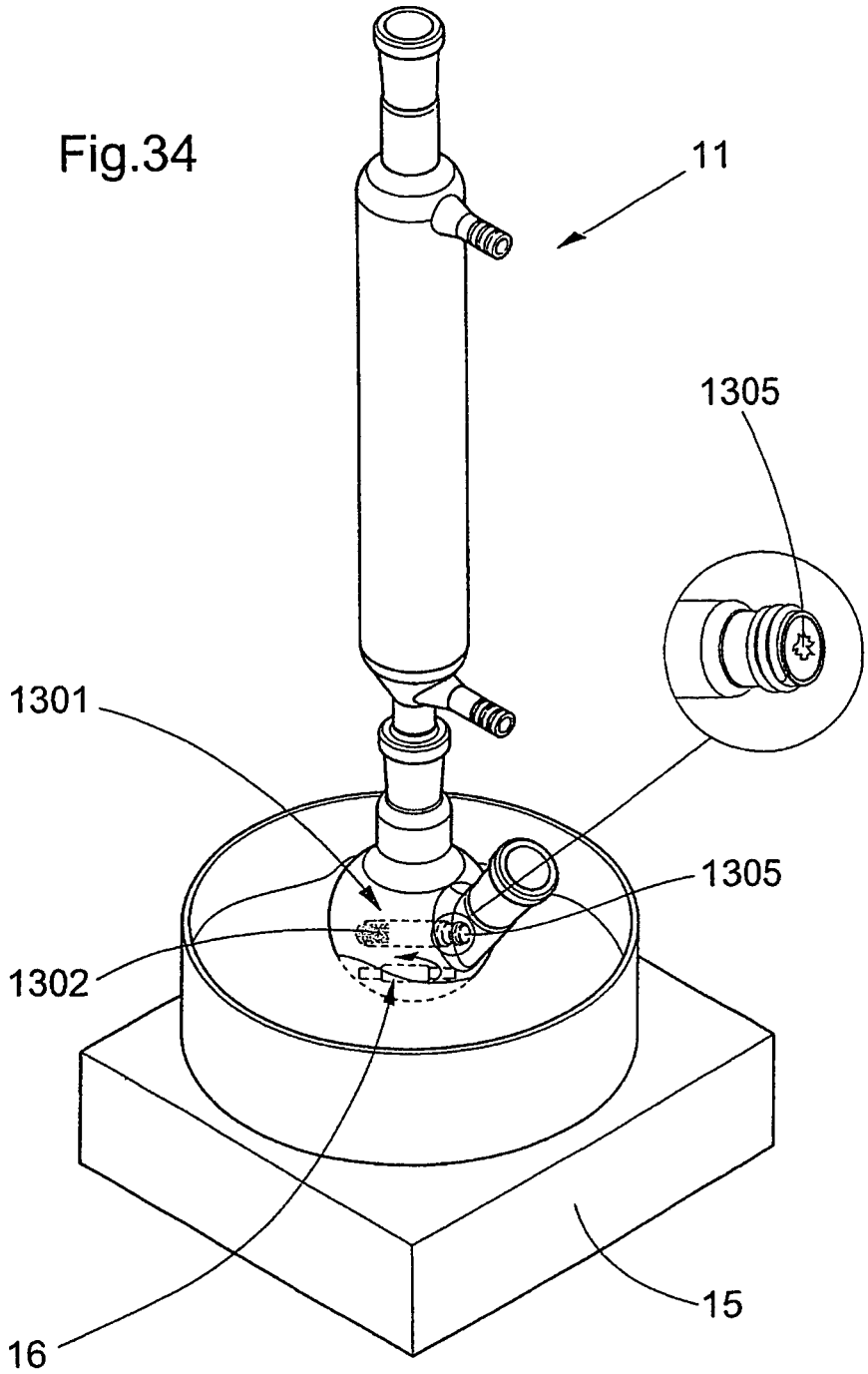
FIG. 34—a perspective view of an apparatus according to FIG. 4, a container which has not yet been destroyed and contains a premetered amount of a substance being shown here in the reaction solution.
Figure 35:
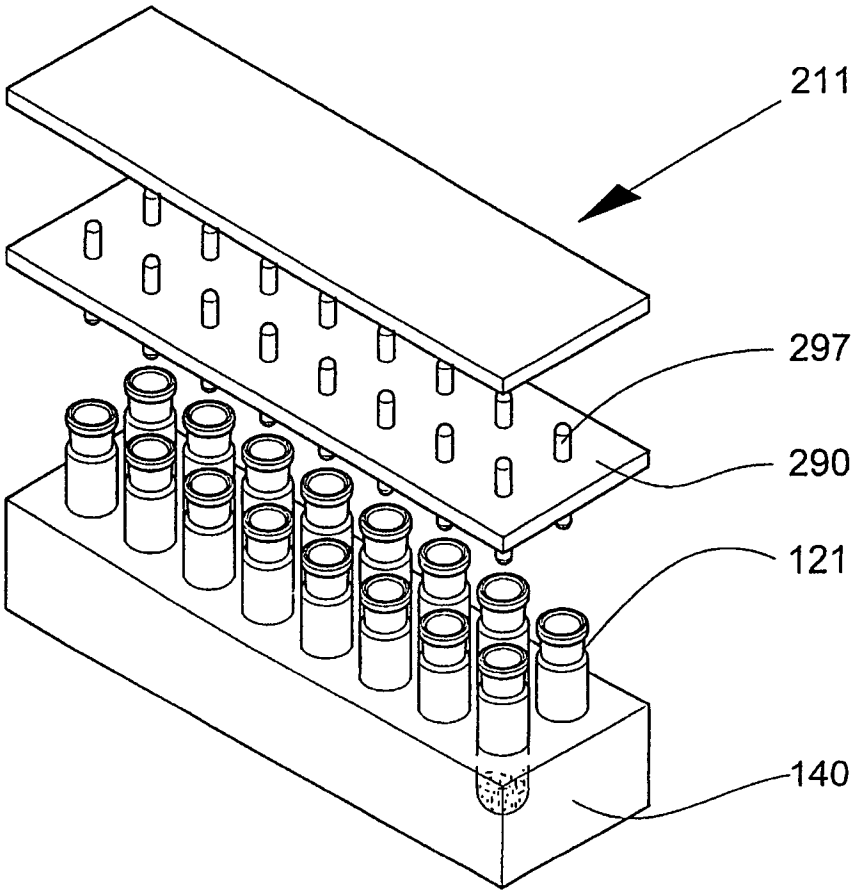
FIG. 35—a schematic perspective view of an apparatus comprising parallel reactors to which a set of containers with premetered substances is added in parallel.

FIGS. 31 and 32

An alternative embodiment of a container 1201 according to the invention comprises a cylindrical hollow body 1203 having a wall thickness $b_{12}$, for example 0.7 mm, a spherical bottom 1204 and a thread part 1207 adjacent to the hollow body 1203 and above said hollow body. The container 1201 contains a premetered amount of a substance 1202 and, above this, a cavity 1206. It can be sealed by welding on or bonding on a relatively thin cover 1205, preferably of the same material. If desired, the thread 1207 makes it possible to screw on a removable safety cap. This can be provided with a septum and screwed on before the first piercing.

Alternatively, the container cover may be fastened to the container by means of an exactly defined reduced pressure in the container itself. As soon as the container is introduced into the reaction vessel and the latter is subjected to reduced pressure which is comparable with that of the interior of the container, the cover becomes detached by itself or at the latest with shaking or stirring of the reaction vessel.

In another embodiment, the containers 1201 are made of a metal, e.g. stainless steel and are sealed air-tight in the opening region with a commercially available bursting disk. The bursting disk can be screwed onto the container 1201 by means of a cap which, for example, likewise consists of stainless steel.

FIG. 33

Here, the container 1201 according to FIG. 32 has been pierced with a needle 798 in the region of the cover 1205, which forms a predetermined breaking zone. The needle 798 now adds solvent 1208 for dissolving the premetered substance 1202. The possible sequences are evident correspondingly from FIG. 9 to 13.

FIG. 34

Figure 5:
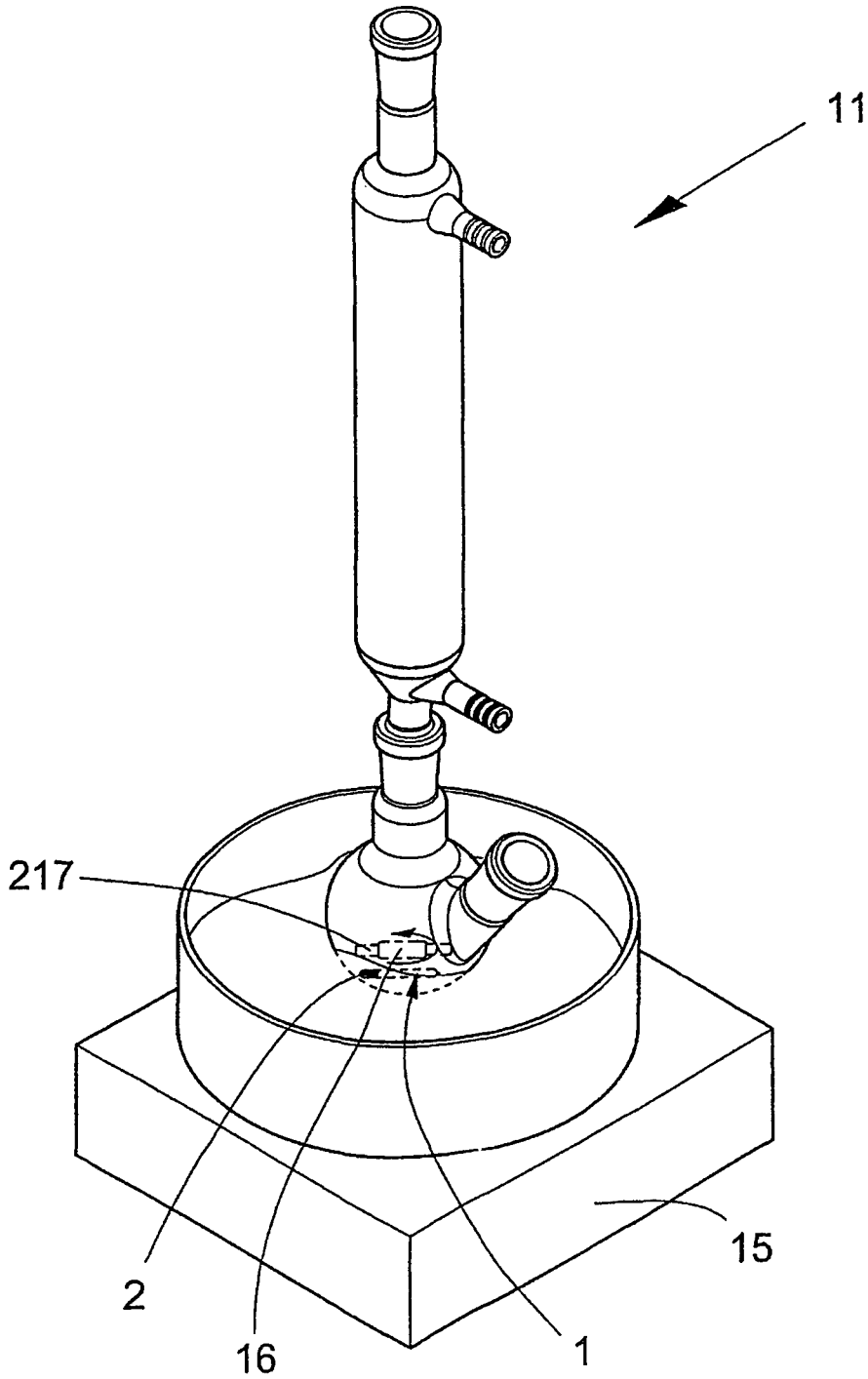
FIG. 5—a perspective view of the apparatus of FIG. 4.

The apparatus 11 shown corresponds to that according to FIG. 5, but a container 1301 which contains a premetered amount of a substance 1302 and corresponds to the container 1201 according to FIG. 32 has been introduced into the reaction vessel. As a result of switching on the schematically shown magnetic stirrer motor 15, the container 1301 has been irreversibly opened by the magnetic stirring rod 16 in the region of the cover in the form of predetermined breaking zone 1305, this being effected at a desired time. The exact nature of the container 1301 or of the predetermined breaking zone 1305, i.e. the thickness and the material or the design of the predetermined breaking zone 1305, as well as the frequency at which the magnetic stirring rod 16 rotates, plays a decisive role here. Thus, container 1301 or predetermined breaking zones 1305 can be such that they are opened with the slightest movement or only after application of a relatively large force. Depending on the design, a continuous or even chamber-like opening is also conceivable. In addition, the bottom may also be in the form of a predetermined breaking zone.

FIG. 35

Sixteen reaction vessels 121 are held here in a support 140. Sixteen containers 297 sealed air-tight, containing premetered amounts of substances and inserted into a plate 290 or into a plate which has through-holes and is for example covered underneath by a foil, in particular aluminum foil, and may also be covered on top can be pressed (manually or by means of a robot) simultaneously into the reaction vessels 121 by means of a plate 211. It is also possible to press the containers 297 individually, together or group by group into the reaction vessels 121 by means of punches which are not shown (which are necessary in the case of a plate covered underneath and on top with a foil) which punches can be mounted on a plate or can be controlled individually, together or group by group manually or by a robot. The containers 297 can be opened simultaneously.

FIGS. 36 to 39

FIG. 36 to 39 show the production of a very thin glass rod 2004, which can then be used, for example as described in connection with FIGS. 15.1 to 15.4, for the production of blanks for containers according to the invention which have a very small wall thickness.

Figures 36, 37, 38, 39:
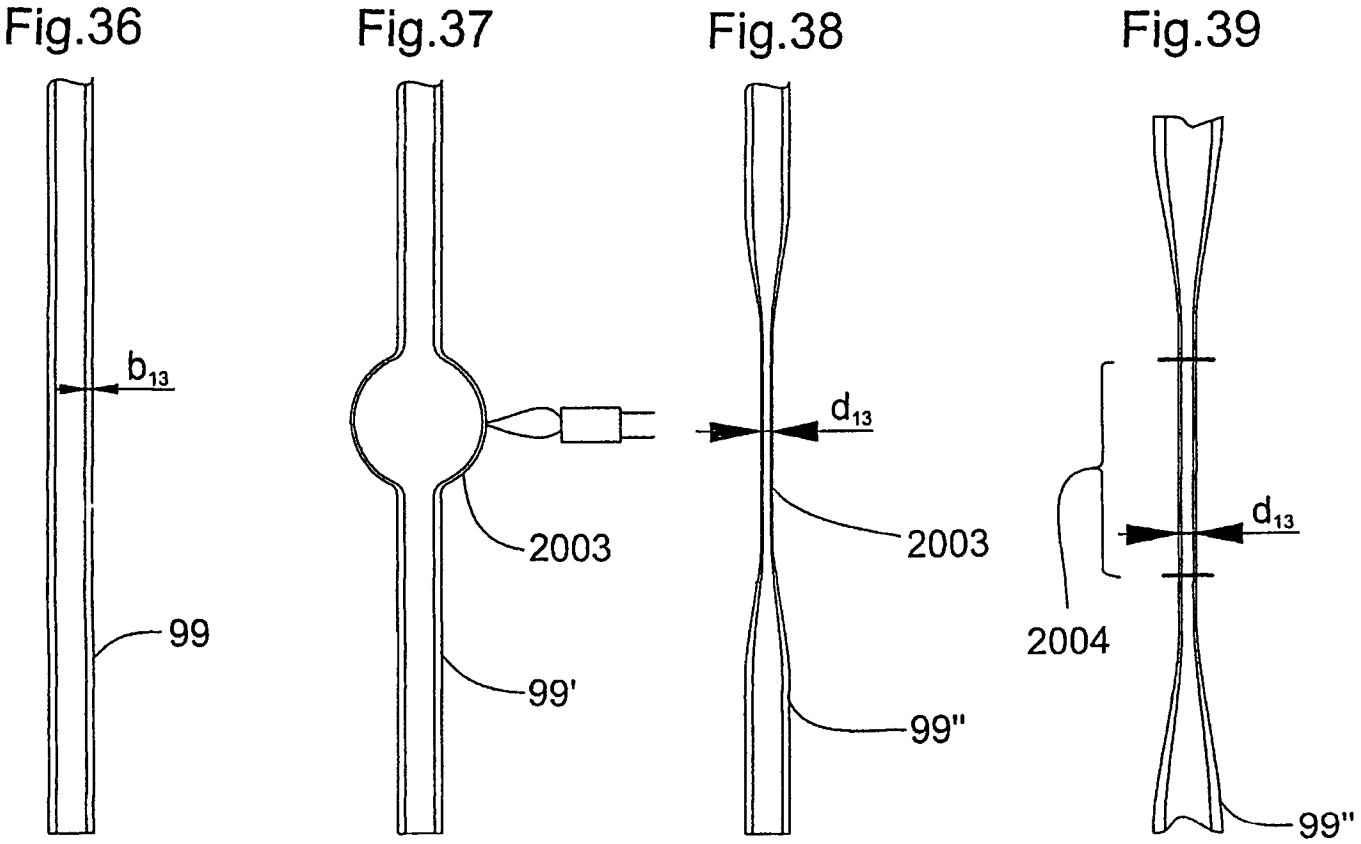
FIG. 36—a hollow glass rod which serves for producing a blank.
FIG. 37—a hollow blank for producing a container having a very thin wall.
FIG. 38—a hollow glass rod which is drawn at a point to a length of about 15 cm to give a very thin glass rod.
FIG. 39—the hollow glass rod of FIG. 38, in which the part which has a thin wall and a desired external diameter has been cut out.
Figures 40, 41:
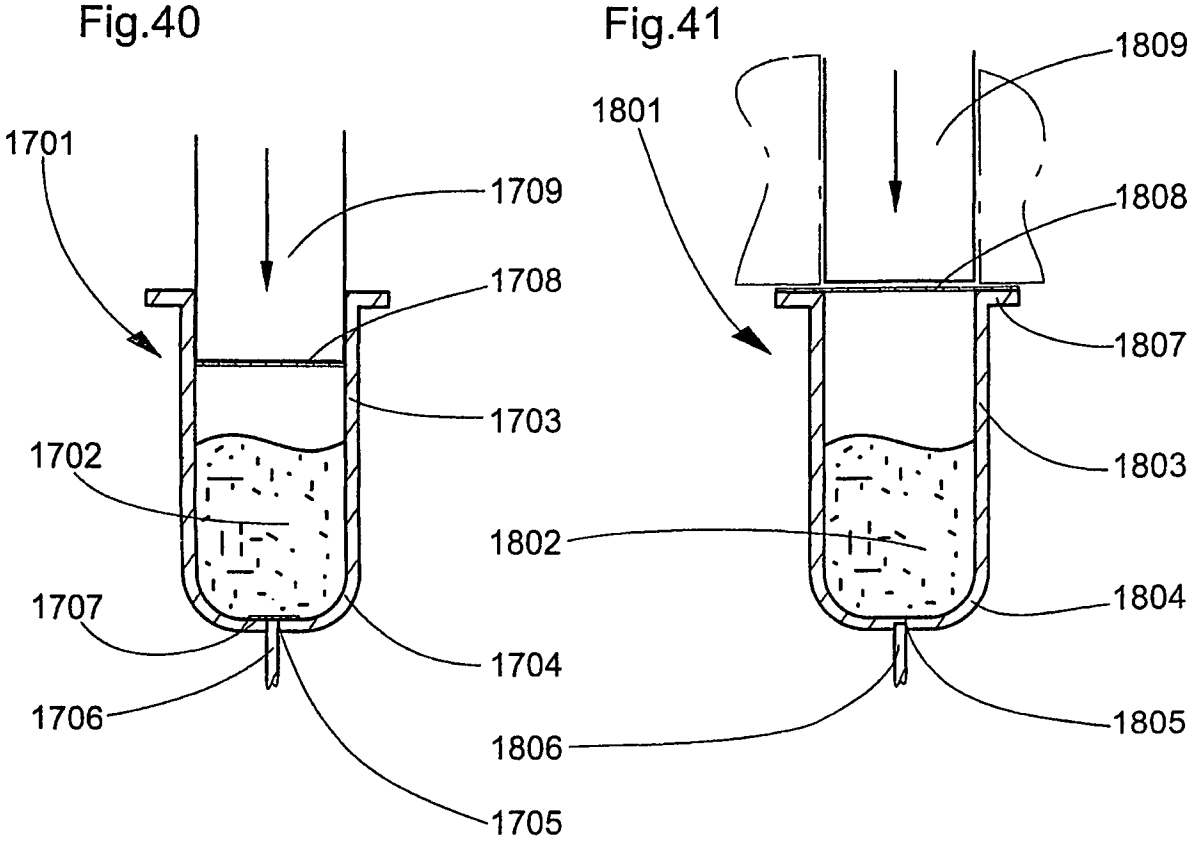
FIG. 40—a longitudinal section of an alternative embodiment of a container according to the invention which is sealed air-tight and is in the form of a syringe which is closed with a glass sheet on the needle side.
FIG. 41—a longitudinal section of an alternative embodiment of a container according to the invention which is sealed air-tight and is in the form of a syringe which is closed with a glass wall on the needle side.

A hollow glass rod 99 having a relatively large wall thickness $b_{13}$ of, for example, 2 mm, as shown in FIG. 36, is heated at a point 2003 according to FIG. 37 and blown out manually or mechanically to give the blank 99'. This is then drawn out, according to FIG. 38, at a point 2003 to a length of about 15 cm to give a very thin, e.g. 0.04 mm thick, glass rod which has an external diameter $d_{13}$ and is part of the blank 99". The thin glass rod 2004 is then cut out according to FIG. 39.

FIG. 40

In this alternative embodiment, the container 1701 according to the invention which is sealed air-tight and contains a premetered amount of a substance 1702 is in the form of a syringe and comprises a substantially cylindrical hollow body 1703 having a rounded bottom 1704. The bottom 1704 has a continuous opening 1705 into which a hollow needle 1706 has been welded. The opening of the hollow needle 1706 is sealed air-tight by a thin glass sheet 1707 which has been applied by adhesive bonding or welded on. Above the substance 1702, the cylindrical hollow body 1703 is sealed air-tight by a thin glass sheet 1708 which has been applied by adhesive bonding or welded on. The cylindrical hollow body 1703 and the bottom 1704 are preferably made of glass, while the hollow needle 1706 is preferably made of metal.

By moving a syringe piston 1709 in the direction of the arrow, the glass sheet 1708 is destroyed, the substance 1702 is forced downward and thus the glass sheet 1707 is likewise destroyed, so that the substance 1702 can be released through the hollow needle 1706.

Alternatively, instead of the thin glass sheet 1708, a thin glass wall may be provided as part of the container wall, in which case the container 1701 is filled either via the continuous opening 1705 or before completion of its wall.

FIG. 41

In this alternative embodiment, the container 1801 according to the invention which is sealed air-tight and contains a premetered amount of a substance 1802 is once again in the form of a syringe and comprises a substantially cylindrical hollow body 1803 having a rounded bottom 1804 and a flange 1807 at its upper end. The bottom 1804 has a blind hole 1805 into which a hollow needle 1806 has been welded. The cylindrical hollow body 1803 is sealed air-tight on the one hand from the hollow needle 1806 by the thin remainder of the bottom wall 1804 and, on the other hand, above the substance 1802 by a thin glass sheet 1808 adhesively bonded or welded to the flange 1807. The cylindrical hollow body 1803 and the bottom 1804 are preferably made of glass while the hollow needle 1806 is preferably made of metal.

By moving a syringe piston 1809 in the direction of the arrow, the glass sheet 1808 is destroyed, the substance 1802 is forced downward and the thin remainder of the bottom wall 1804 above the hollow needle 1806 is thus destroyed so that the substance 1802 can be released through the hollow needle 1806.

Alternatively, instead of the thin glass sheet 1808, a thin glass wall may be provided as part of the container wall in which case the container 1801 is filled before completion of its walls.

The following table 1 lists a set of 50 substances which have been packed air-tight in 7 different mmol amounts in glass containers according to FIG. 1. The stated percentages in column 2 are purity data. The mmol amounts have been corrected with respect to purity. At least 96 containers of each substance in each amount have been produced. Various other embodiments of containers with substances in different amounts, corresponding to the patent claims, have also been realized.

| No. | Substance | Amount of substance in a container, based on mmol content | | | | | | |
|---|---|---|---|---|---|---|---|---|
| 1 | Cyclohexanol ($C_6H_{12}O$) 29100, 99%, Fluka | 0.01 | 0.05 | 0.1 | 0.5 | 1.0 | 5.0 | 10.0 |
| 2 | Sodium hydride (NaH) 71620, 55–65%, Fluka | 0.01 | 0.05 | 0.1 | 0.5 | 1.0 | 5.0 | 10.0 |
| 3 | Benzyl bromide ($C_7H_7Br$) 13250, 98%, Fluka | 0.01 | 0.05 | 0.1 | 0.5 | 1.0 | 5.0 | 10.0 |

-continued

| No. | Substance | Amount of substance in a container, based on mmol content | | | | | | |
|---|---|---|---|---|---|---|---|---|
| 4 | Aqueous HBr 48% (stated mmol amounts are based on HBr), 18710, Fluka | 0.01 | 0.05 | 0.1 | 0.5 | 1.0 | 5.0 | 10.0 |
| 5 | N,N-Dimethylformamide ($C_3H_7NO$) 40228, 99.5%, Fluka | 0.01 | 0.05 | 0.1 | 0.5 | 1.0 | 5.0 | 10.0 |
| 6 | Sodium borohydride ($NaBH_4$) 71321, 96%, Fluka | 0.01 | 0.05 | 0.1 | 0.5 | 1.0 | 5.0 | 10.0 |
| 7 | Lithium aluminum hydride ($LiAlH_4$) 62420, 97%, Fluka | 0.01 | 0.05 | 0.1 | 0.5 | 1.0 | 5.0 | 10.0 |
| 8 | Boron tribromide ($BBr_3$) 15690, 99%, Fluka | 0.01 | 0.05 | 0.1 | 0.5 | 1.0 | 5.0 | 10.0 |
| 9 | Boron trifluoride-ethyl etherate $BF_3.Et_2O$ 15719, Fluka | 0.01 | 0.05 | 0.1 | 0.5 | 1.0 | 5.0 | 10.0 |
| 10 | Butyl lithium solution, ($C_4H_9Li$) 20161, ~10M (stated mmol amounts are based on $C_4H_9Li$) in hexane, Fluka | 0.01 | 0.05 | 0.1 | 0.5 | 1.0 | 5.0 | 10.0 |
| 11 | tert-Butyllithium solution ($C_4H_9Li$) 20190, ~1.5M (stated mmol amounts are based on $C_4H_9Li$) in pentane, Fluka | 0.01 | 0.05 | 0.1 | 0.5 | 1.0 | 5.0 | 10.0 |
| 12 | tert-Butylmagnesium chloride solution ($C_4H_9MgCl$) 20194, ~1.6M (stated mmol amounts are based on $C_4H_9MgCl$) in tetrahydrofuran, Fluka | 0.01 | 0.05 | 0.1 | 0.5 | 1.0 | 5.0 | 10.0 |
| 13 | Lithium borohydride, ($LiBH_4$) 62725, 95%, Riedel de Häen | 0.01 | 0.05 | 0.1 | 0.5 | 1.0 | 5.0 | 10.0 |
| 14 | 2-Diisopropyl-aminoethylamine ($C_8H_{20}N_2$) 38320, 97%, Fluka | 0.01 | 0.05 | 0.1 | 0.5 | 1.0 | 5.0 | 10.0 |
| 15 | Lithium diisopropylamide propylamide ($C_6H_{14}LiN$) 62491, ~2.2M (stated mmol amounts are based on $C_6H_{14}LiN$) in THF/heptane/ethyl-benzene, Fluka | 0.01 | 0.05 | 0.1 | 0.5 | 1.0 | 5.0 | 10.0 |
| 16 | Aluminum chloride ($AlCl_3$) 06220, 99%, Fluka | 0.01 | 0.05 | 0.1 | 0.5 | 1.0 | 5.0 | 10.0 |
| 17 | Methanesulfonyl chloride ($CH_3SO_2Cl$) 64260, 99%, Fluka | 0.01 | 0.05 | 0.1 | 0.5 | 1.0 | 5.0 | 10.0 |
| 18 | Acetyl chloride ($CH_3COCl$) 00990, 99%, Fluka | 0.01 | 0.05 | 0.1 | 0.5 | 1.0 | 5.0 | 10.0 |

-continued

| No. | Substance | Amount of substance in a container, based on mmol content | | | | | | |
|---|---|---|---|---|---|---|---|---|
| 19 | Acetic anhydride, $(CH_3CO)_2O$ 45830, 99.5%, Fluka | 0.01 | 0.05 | 0.1 | 0.5 | 1.0 | 5.0 | 10.0 |
| 20 | Trifluoroacetic anhydride, $(CF_3CO)_2O$ 91720, 98%, Fluka | 0.01 | 0.05 | 0.1 | 0.5 | 1.0 | 5.0 | 10.0 |
| 21 | Toluene-4-sulfonic acid monohydrate, ($C_7H_8O_3S.H_2O$) 89760, 99%, Fluka | 0.01 | 0.05 | 0.1 | 0.5 | 1.0 | 5.0 | 10.0 |
| 22 | Toluene-4-sulfonyl chloride ($C_7H_7SO_2Cl$) 89730, 99%, Fluka | 0.01 | 0.05 | 0.1 | 0.5 | 1.0 | 5.0 | 10.0 |
| 23 | Aluminum bromide ($AlBr_3$) 06180, 98%, Fluka | 0.01 | 0.05 | 0.1 | 0.5 | 1.0 | 5.0 | 10.0 |
| 24 | Methyllithium solution, ($CH_3Li$) 67740, ~1.6M in diethyl ether, Fluka | 0.01 | 0.05 | 0.1 | 0.5 | 1.0 | 5.0 | 10.0 |
| 25 | Methylmagnesium bromide solution, ($CH_3MgBr$) 67742, ~3M in diethyl ether, Fluka | 0.01 | 0.05 | 0.1 | 0.5 | 1.0 | 5.0 | 10.0 |
| 26 | Ethylmagnesium bromide solution ($CH_3CH_2MgBr$) 46103, ~3M in diethyl ether, Fluka | 0.01 | 0.05 | 0.1 | 0.5 | 1.0 | 5.0 | 10.0 |
| 27 | Titanium(III) chloride ($TiCl_3$) 89487, Fluka | 0.01 | 0.05 | 0.1 | 0.5 | 1.0 | 5.0 | 10.0 |
| 28 | Diethylaluminum chloride, $(CH_3CH_2)_2$ AlCl 31724, Fluka | 0.01 | 0.05 | 0.1 | 0.5 | 1.0 | 5.0 | 10.0 |
| 29 | Diethylaluminum hydride, $(CH_3CH_2)_2$ AlH 31728, Fluka | 0.01 | 0.05 | 0.1 | 0.5 | 1.0 | 5.0 | 10.0 |
| 30 | Diethylamine $(CH_3CH_2)_2NH$ 31729, 99.7%, Fluka | 0.01 | 0.05 | 0.1 | 0.5 | 1.0 | 5.0 | 10.0 |
| 31 | Sodium, (Na) 71172, 98%, Fluka | 0.01 | 0.05 | 0.1 | 0.5 | 1.0 | 5.0 | 10.0 |
| 32 | Potassium, (K) 60030, 98%, Riedel de Häen | 0.01 | 0.05 | 0.1 | 0.5 | 1.0 | 5.0 | 10.0 |
| 33 | Lithium, (Li) 62361, 99%, Fluka | 0.01 | 0.05 | 0.1 | 0.5 | 1.0 | 5.0 | 10.0 |
| 34 | Bromine ($Br_2$) 16040, 99.5%, Fluka | 0.01 | 0.05 | 0.1 | 0.5 | 1.0 | 5.0 | 10.0 |
| 35 | Imidazole ($C_3H_4N_2$) 56750, 99.5%, Fluka | 0.01 | 0.05 | 0.1 | 0.5 | 1.0 | 5.0 | 10.0 |
| 36 | Iodine ($I_2$) 57650, 99.8%, Fluka | 0.01 | 0.05 | 0.1 | 0.5 | 1.0 | 5.0 | 10.0 |
| 37 | Sodium hydroxide (NaOH) 71691, 98%, Fluka | 0.01 | 0.05 | 0.1 | 0.5 | 1.0 | 5.0 | 10.0 |
| 38 | Thiophenol ($C_6H_5SH$) 89021, 98%, Fluka | 0.01 | 0.05 | 0.1 | 0.5 | 1.0 | 5.0 | 10.0 |

-continued

| No. | Substance | Amount of substance in a container, based on mmol content | | | | | | |
|---|---|---|---|---|---|---|---|---|
| 39 | Nitromethane ($CH_3NO_2$) 73479, 97%, Fluka | 0.01 | 0.05 | 0.1 | 0.5 | 1.0 | 5.0 | 10.0 |
| 40 | Sodium iodide, (NaI) 71710, 99.5%, Fluka | 0.01 | 0.05 | 0.1 | 0.5 | 1.0 | 5.0 | 10.0 |
| 41 | Palladium(II) acetate $(CH_3COO)_2Pd$ 76044, 47%, Fluka | 0.01 | 0.05 | 0.1 | 0.5 | 1.0 | 5.0 | 10.0 |
| 42 | Palladium chloride ($PdCl_2$) 76050, 60%, Fluka | 0.01 | 0.05 | 0.1 | 0.5 | 1.0 | 5.0 | 10.0 |
| 43 | Palladium on active carbon, (Pd) 75990, 10% (stated mmol amounts are based on Pd), Fluka | 0.01 | 0.05 | 0.1 | 0.5 | 1.0 | 5.0 | 10.0 |
| 44 | Tetrakis (triphenylphosphine)-palladium (Pd $[(C_6H_5)_3P]_4$ 87645, 97%, Fluka | 0.01 | 0.05 | 0.1 | 0.5 | 1.0 | 5.0 | 10.0 |
| 45 | Triphenylphosphine $(C_6H_5)_3P$ 93090, 99%, Fluka | 0.01 | 0.05 | 0.1 | 0.5 | 1.0 | 5.0 | 10.0 |
| 46 | Samarium (II) iodide solution ($SmI_2$) 84453, ~0.1M (stated mmol amounts are based on $SmI_2$) in tetrahydrofuran, Fluka | 0.01 | 0.05 | 0.1 | 0.5 | 1.0 | 5.0 | 10.0 |
| 47 | Triethylamine, $(CH_3CH_2)_3N$ 90340, 99.5%, Fluka | 0.01 | 0.05 | 0.1 | 0.5 | 1.0 | 5.0 | 10.0 |
| 48 | Methyl iodide ($CH_3I$) 67690, 99.5%, Fluka | 0.01 | 0.05 | 0.1 | 0.5 | 1.0 | 5.0 | 10.0 |
| 49 | Osmium tetroxide ($OsO_4$) 75631, 99.9%, Fluka | 0.01 | 0.05 | 0.1 | 0.5 | 1.0 | 5.0 | 10.0 |
| 50 | 3-Chloroperbenzoic acid ($C_7H_5ClO_3$), 25800, 70%, Fluka | 0.01 | 0.05 | 0.1 | 0.5 | 1.0 | 5.0 | 10.0 |

Whether the system is based on, for example, $2\times10^{-x}$, $3\times10^{-x}$, $3.01\times10^{-x}$ or, as described in table 4, $1.1\times10^{-x}$, etc. mmol or, for example, on a composition of containers with $1\times10^{-x}$, $2\times10^{-x}$ and $5\times10^{-x}$, etc. or, as described in the above table, on $1\times10^{-x}$ and $5\times10^{-x}$ does not in principle play any role. In the examples shown here, x is expediently an even number.

Three examples of chemical reactions which were carried out in the classical manner and according to the invention are described below.

EXAMPLE 1

Alkylation of an Alcoholate with an Alkyl Halide (Williamson Ether Synthesis)

The chemist has planned the following reaction known among those skilled in the art as a Williamson ether synthesis. The method recorded below corresponds to the classical procedure for the reaction, i.e. the procedure without the use of containers according to the invention and without the use of the method according to the invention:

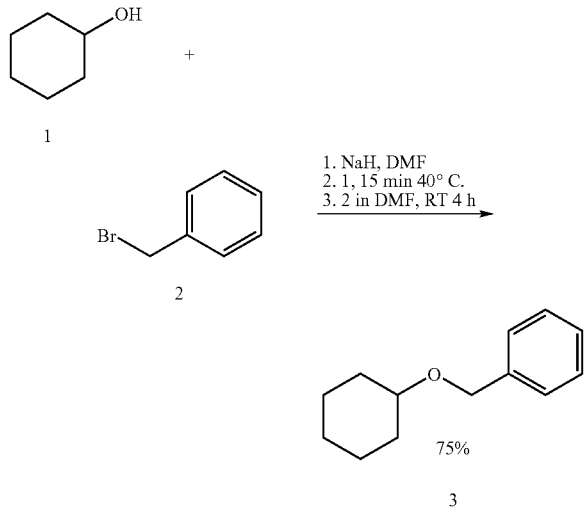

a) Strictly Classically Performed Experiment 10 ml of solvent (dimethylformamide) were initially introduced by means of a commercially available disposable syringe into a reaction vessel which had been provided with an inert atmosphere. The alcohol 1 (0.1002 g, 0.106 ml, 1 mmol) was then metered into the reaction mixture. Sodium hydride (0.044 g of a 60% strength dispersion in oil, 1.1 mmol, 1.1 eq.) was then added to the reaction mixture. The reaction mixture was heated to 40° C. for 15 minutes and benzyl bromide 2 (0.171 g, 0.109 ml, 1.0 mmol, 1.0 eq.) was then added at room temperature. The reaction mixture was stirred for 4 hours at room temperature. Thereafter, 10 M $HBr_{aq}$ was added (0.2 ml, 2 mmol, 2 eq., based on HBr), the mixture was filtered and the filtrate was evaporated down in vacuo.

b) Novel Method Using Reagent Container Mixed with Classical Parts

This reaction was now carried out using the method according to the invention and a container according to the invention, filled with benzyl bromide. The deviations from the classical method are described below:

In this embodiment of the method according to the invention, 10 ml of solvent (dimethylformamide) were initially introduced by means of a commercially available disposable syringe into the reaction vessel provided with an inert atmosphere. The alcohol 1 (0.1002 g, 0.106 ml, 1 mmol) was then metered into the reaction mixture. Sodium hydride (0.044 g of a 60% strength dispersion in oil (1.1 mmol, 1.1 eq.) was then added to the reaction mixture. The reaction mixture was heated to 40° C. for 15 minutes and a 1.0 mmol container filled with benzyl bromide (0.171 mg, 0.109 ml, 1.0 mmol, 1 eq.) was then added to the reactor at room temperature. The moving magnetic stirrer destroyed the container automatically in this embodiment. The benzyl bromide was subsequently released in the reaction mixture and could thus react with the reactor already initially introduced. The reaction mixture was stirred for 4 hours at room temperature. Thereafter, 10 M $HB_{raq}$ was added (0.2 ml, 2 mmol, 2 eq., based on HBr) and the filtrate was evaporated down in vacuo.

c) Novel Method Using Reagent Containers, but Solvent Metered in Classically

This reaction was carried out using the method according to the invention and containers according to the invention, as shown in table 1. Only the solvent was metered in classically. The deviations from the classical method are described below:

In this simple embodiment of the method, as described in independent patent claim 1, the solvent (dimethylformamide) was initially introduced by means of a commercially available disposable syringe into the reaction vessel provided with an inert atmosphere. The alcohol 1 (0.1002 g, 0.106 ml, 1.0 mmol), filled in a 1.0 mmol container, was thrown by hand into the reaction vessel (brief manual opening of the reaction vessel during addition). The moving magnetic stirrer destroyed the container automatically in this embodiment. The alcohol was subsequently released and dissolved in the initially introduced dimethylformamide.

The experimenter then added a 1.0 mmol container of sodium hydride (0.024 g, 1.0 mmol, 1.0 eq.). Since, as described above, he had to use 1.1 equivalents, a further 0.1 mmol container of sodium hydride (0.0024 g, 0.1 mmol, 0.1 eq.) was added. These containers, too, were automatically destroyed and the sodium hydride suspended in dimethylformamide. The reaction mixture was heated to 40° C. for 15 minutes and then a further 1.0 mmol container of benzyl bromide (0.171 mg, 0.109 ml, 1.0 mmol, 1.0 eq.) was added at room temperature. The reaction mixture was stirred for 4 hours at room temperature. Thereafter, two 1.0 mmol containers with 10 M $HB_{raq}$ (each 0.1 ml, 1.0 mmol, based on HBr) were added in succession to the solution, the reaction mixture was filtered and the filtrate was evaporated down.

d) Novel Method Using Reagent Containers and Solvent Containers

This reaction was carried out using the method according to the invention and containers according to the invention, as shown in table 1. The solvent, dimethylformamide (14.62 g, 10.2 ml, 0.2 mol), was also added in a form filled into four 0.05 mol containers. The alcohol 1 (0.1002 g, 0.106 ml, 1.0 mmol), filled into a 1.0 mmol container, was then thrown by hand into the reaction vessel (brief manual opening of the reaction vessel during the addition). The moving magnetic stirrer destroyed the container automatically in this embodiment. The alcohol was subsequently released and dissolved in the initially introduced dimethylformamide. The experimenter then added a 1.0 mmol container of sodium hydride (0.024 g, 1.0 mmol, 1.0 eq.) as described above. Since, as described above, he had to use 1.1 equivalents, a further 0.1 mmol container of sodium hydride (0.0024 g, 0.1 mmol, 0.1 eq.) was added. This container, too, was automatically destroyed and the sodium hydride suspended in dimethylformamide. The reaction mixture was heated to 40° C. for 15 minutes and a further 1.0 mmol container of benzyl bromide (0.171 mg, 0.109 ml, 1.0 mmol, 1.0 eq.) was then added at room temperature. The reaction mixture was stirred for 4 hours at room temperature. Thereafter, two 1.0 mmol containers of 10 M $HB_{raq}$ (each 0.1 ml, 1.0 mmol., based on HBr) were added in succession to the solution, the reaction mixture was filtered and the filtrate was evaporated down.

EXAMPLE 2

Synthesis of a Substituted Aminocyclohexane Library by Double Reductive Amination in the Key Step

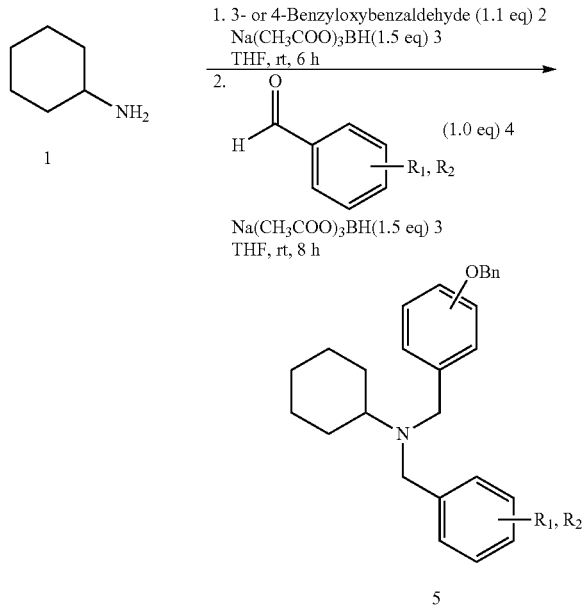

The aldehyde building block and batch sizes for this example are shown in table 2 below:

| | Aldehyde and reagent data used for the 1st step | X mg of reagent | Aldehyde and reagent data used for 2nd step | Y mg or µl of reagent |
|---|---|---|---|---|
| 1 | 3-Benzyloxy-benzaldehyde (M = 212.25, 95%) | 24.5 mg | 2,4-Dichloro-benzaldehyde (M = 175.01, 99%) | 17.7 mg |
| 2 | 3-Benzyloxy-benzaldehyde (M = 212.25, 95%) | 24.5 mg | 4-Methoxybenzaldehyde (M = 136.15, d = 1.119, 98%) | 12.4 µl |
| 3 | 3-Benzyloxy-benzaldehyde (M = 212.25, 95%) | 24.5 mg | 4-tert-Butoxy-benzaldehyde (M = 162.23, d = 0.969, 97%) | 17.2 µl |
| 4 | 3-Benzyloxy-benzaldehyde (M = 212.25, 95%) | 24.5 mg | 4-Phenyloxybenzaldehyde (M = 198.22, d = 1.132, 98%) | 17.8 µl |
| 5 | 4-Benzyloxy-benzaldehyde (M = 212.25, 97%) | 24.0 mg | 2,4-Dichloro-benzaldehyde (M = 175.01, 99%) | 17.7 mg |
| 6 | 4-Benzyloxy-benzaldehyde (M = 212.25, 97%) | 24.0 mg | 4-Methoxybenzaldehyde (M = 136.15, d = 1.119, 98%) | 12.4 µl |
| 7 | 4-Benzyloxy-benzaldehyde (M = 212.25, 97%) | 24.0 mg | 4-tert-Butoxy-benzaldehyde (M = 162.23, d = 0.969, 97%) | 17.2 µl |
| 8 | 4-Benzyloxy-benzaldehyde (M = 212.25, 97%) | 24.0 mg | 4-Phenyloxybenzaldehyde (M = 198.22, d = 1.132, 98%) | 17.8 µl |

a) Classical Experiment

1st stage: 9.91 mg (0.100 mmol, M=99.1, 1.00 eq.) of aminocyclohexane 1 were dissolved in 1.5 ml of dry THF per reactor. X mg (0.110 mmol, 1.1 eq.) of the first aldehyde 2 (3- or 4-benzyloxybenzaldehyde) were added and the reaction mixture was stirred for 10 min under inert gas at room temperature. Thereafter, 30.2 mg of sodium triacetoxyborohydride 3 (0.15 mmol, 1.5 eq.) were added and the reaction was stirred for 6 h under inert gas at room temperature.

2nd stage: Y mg or μl (0.100 mmol, 1.0 eq.) of the second aldehyde 4 and 30.2 mg of sodium triacetoxyborohydride 3 (0.15 mmol, 1.5 eq.) were added and the reaction mixture was stirred for 10 h under inert gas at room temperature.

Working-up: The reactions were monitored by TLC (petroleum ether/ethyl acetate 7:3), then evaporated to dryness and used directly in the next step without further purification.

b) Novel Method Using Reagent Containers

1st stage: 1.5 ml of dry THF were initially introduced per reactor. A 0.100 mmol container (9.91 mg, 1.00 eq.) of aminocyclohexane 1 was added with thorough stirring. In all cases of addition of a container, the thorough stirring results in the release of the reagent from the container, in this case by irreversible destruction of the glass container. A 0.100 mmol container and a 0.010 mmol container (altogether X mg, 1.1 eq.) of the first aldehyde 2 (3- or 4-benzyloxybenzaldehyde) were added to the reactor with stirring. After 10 minutes, a 0.100 mmol container and a 0.050 mmol container of sodium triacetoxyborohydride 3 (altogether 30.2 mg, 1.5 eq.) were added to the reactor and thorough stirring was effected for 6 hours at room temperature under inert gas.

2nd stage: A 0.100 mmol container (Y mg or μl, 1.0 eq.) of the second aldehyde 4 and a 0.100 mmol container and a 0.050 mmol container of sodium triacetoxyborohydride 3 (altogether 30.2 mg, 1.5 eq.) were then added to the reactor and the reagents were released from the containers by thorough stirring. The reaction mixture was stirred for 10 hours under inert gas at room temperature.

Working-up: The reactions were monitored by TLC (petroleum ether/ethyl acetate 7:3), filtration was effected (removal of the container residues), the filtrate was then evaporated to dryness and the residue was used in the next step without further purification.

EXAMPLE 3

Preparation of α,β-unsaturated Enones by Horner-Emmons Reaction

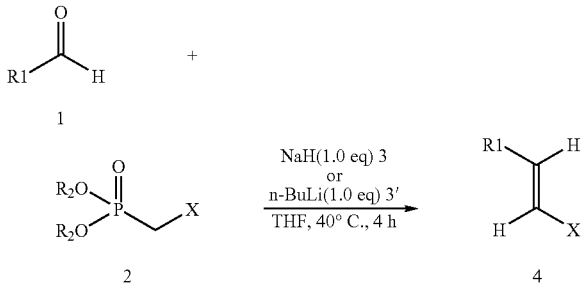

2a: $R_2$ = Me, X = CO—$CH_3$

2b: $R_2$ = Et, X = $(CH_2)_2CN$

The building blocks and batch sizes for this example are shown in table 3 below:

| | Aldehyde and reagent data | X mg of added reagent | Phosphonate and reagent data | Y mg or μl of reagent | Base and reagent data | Z mg or μl of reagent |
|---|---|---|---|---|---|---|
| 1 | Naphthaldehyde (M = 156.19, 97%) | 1.610 g | Dimethyl acetylmethylphosphonate (M = 166.12, d = 1.202, 97%) | 1.57 ml | NaH (M = 24.00, 55%) | 436 mg |
| 2 | Naphthaldehyde (M = 156.19, 97%) | 1.610 g | Dimethyl acetylmethylphosphonate (M = 166.12, d = 1.202, 97%) | 1.57 ml | BuLi (10M in hexane) | 1.0 ml |
| 3 | Naphthaldehyde (M = 156.19, 97%) | 1.610 g | Diethyl (1-cyanoethyl) phosphonate (M = 191.17, d = 1.085, 98%) | 1.98 ml | NaH (M = 24.00, 55%) | 436 mg |
| 4 | Naphthaldehyde (M = 156.19, 97%) | 1.610 g | Diethyl (1-cyanoethyl) phosphonate (M = 191.17, d = 1.085, 98%) | 1.98 ml | BuLi (10M in hexane) | 1.0 ml |
| 5 | o-Tolualdehyde (M = 120.15, d = 1.039, 97%) | 1.19 ml | Dimethyl acetylmethylphosphonate (M = 166.12, d = 1.202, 97%) | 1.57 ml | NaH (M = 24.00, 55%) | 436 mg |
| 6 | o-Tolualdehyde (M = 120.15, d = 1.039, 97%) | 1.19 ml | Dimethyl acetylmethylphosphonate (M = 166.12, d = 1.202, 97%) | 1.57 ml | BuLi (10M in hexane) | 1.0 ml |
| 7 | o-Tolualdehyde (M = 120.15, d = 1.039, 97%) | 1.19 ml | Diethyl (1-cyanoethyl) phosphonate (M = 191.17, d = 1.085, 98%) | 1.98 ml | NaH (M = 24.00, 55%) | 436 mg |

-continued

| | Aldehyde and reagent data | X mg of added reagent | Phosphonate and reagent data | Y mg or µl of reagent | Base and reagent data | Z mg or µl of reagent |
|---|---|---|---|---|---|---|
| 8 | o-Tolualdehyde (M = 120.15, d = 1.039, 97%) | 1.19 ml | Diethyl (1-cyanoethyl) phosphonate (M = 191.17, d = 1.085, 98%) | 1.98 ml | BuLi (10M in hexane) | 1.0 ml |

a) Classical Experiment

Y ml of the phosphonate 2 (11.0 mmol, 1.1 eq.) were dissolved in 50 ml of dry THF under inert gas. 436 mg of NaH 3 or 1.0 ml of BuLi 3'(10.0 mmol, 1.0 eq.) were added to this solution while stirring. After 3 minutes at room temperature, aldehyde 1 (10.0 mmol, 1.0 eq.) was added and the reaction mixture was stirred for 4 hours at 55° C.

Working-up: The reaction was monitored by means of TLC (petroleum ether/ethyl acetate 8:2) and then evaporation to dryness was effected. Thereafter, extraction was effected with DCM (20 ml) and water (20 ml) and the organic phase was washed with saturated NaCl solution (20 ml) and dried over sodium sulfate. The further purification of the product was carried out by means of flash chromatography (ether/ethyl acetate 9:1, then 8:2).

b) Novel Method Using Reagent Containers 50 ml of dry THF were initially introduced into a reactor under inert gas. A 10.0 mmol container and a 1.0 mmol container of phosphonate 2 (altogether Y mg or ml, 1.1 eq.) were added to the reactor with thorough stirring. In all cases of addition of a container, the thorough stirring resulted in release of the reagent from the container, in this case by irreversible destruction of the glass container. A 10.0 mmol container of the base 3 or 3' (altogether: Z mg or ml, 1.0 eq.) was then added to the reactor. 3 minutes after this addition, a 10.0 mmol container of aldehyde 1 was added. The reaction mixture was stirred for 4 hours at 55° C.

Working-up: The reaction was monitored by means of TLC (petroleum ether/ethyl acetate 8:2), after which filtration was effected (removal of the container residues), followed by evaporation to dryness. Thereafter, extraction was effected with DCM (20 ml) and water (20 ml) and the organic phase was washed with saturated NaCl solution (20 ml) and dried over sodium sulfate. The further purification of the product was carried out by means of flash chromatography (ether/ethyl acetate 9:1, then 8:2).

The result thus obtained was comparable in every respect to the extremely carefully performed classical reaction, i.e. without the use of containers.

Table 4 below lists a set of 10 substances, which have been packed air-tight in 3 different mmol amounts in glass containers according to FIG. 1. This system of containers has virtually the same advantage with respect to user friendliness as that described in table 1. Thus, for example, a reaction can be carried out with one equivalent of a first substance (e.g. 1 container of the third column) and 1.1 equivalents of a second substance (1 container each of the second and third columns).

| No. | Substance | Amount of substance in a container, based on mmol | | |
|---|---|---|---|---|
| 1 | Benzyl bromide, $C_7H_7Br$, 99% | 0.011 | 0.11 | 1.11 |
| 2 | Sodium hydride, NaH, 55–60% | 0.011 | 0.11 | 1.11 |

-continued

| No. | Substance | Amount of substance in a container, based on mmol | | |
|---|---|---|---|---|
| 3 | Cyclohexanol $C_6H_{12}O$, 98% | 0.011 | 0.11 | 1.11 |
| 4 | 48% $HBr_{aq}$ (mmol, based on HBr) | 0.011 | 0.11 | 1.11 |
| 5 | Dimethylformamide, $C_3H_7NO$, 99.5%, | 0.011 | 0.11 | 1.11 |
| 6 | Sodium borohydride, $NaBH_4$, 96% | 0.011 | 0.11 | 1.11 |
| 7 | Lithium aluminum hydride, $LiAlH_4$, 97% | 0.011 | 0.11 | 1.11 |
| 8 | Boron tribromide, $BBr_3$, 99% | 0.011 | 0.11 | 1.11 |
| 9 | Boron trifluoride ethyl etherate $BF_3\,Et_2O$ | 0.011 | 0.11 | 1.11 |
| 10 | Butyllithium solution, $C_4H_9Li$ ~10M in hexane | 0.011 | 0.11 | 1.11 |

In addition to glass containers, other containers were also tested. The principle of use is virtually identical. The containers are produced from an optimally inert plastic (generally less widely usable compared with glass). Particularly in applications where, for example, cell cultures are used, other materials may be advantageous since the glass residues (container residues) may damage the cells. The results are comparable. The containers are not broken (completely or by means of a predetermined breaking point), as described in the case of glass containers. After the substance has been filled under inert conditions, an adhesive (as small an amount as possible) is used to mount a cover, which becomes detached through the action of a solvent or by means of physical forces (e.g. vigorous stirring or ultrasound) and the corresponding substance is thus released.

By means of the solution according to the invention, comprising containers of different substances with different content based on the number of moles, it is possible to carry out chemical reactions very simply, safely or cleanly, etc. by introducing one, two, three, four or more containers, in a sequence predetermined by the experimenter and under certain conditions, manually, by means of a tool, by means of a robot, etc., into a reaction vessel and by virtue of the fact that the substances mix with one another and/or react with one another, etc. after release from the containers (can also take place shortly before, during or after the addition of containers to the reaction vessel). If the containers are made of, for example, thin glass, they are broken in the course of the addition or shortly thereafter. One or more substances can be added in the classical manner, but at least one substance can be added by means of the container described, in the manner described. The glass residues can be removed shortly before or during the addition, for example by means of a filter (in the case of liquids) or only during or even after the reaction in some manner (e.g. filtration, removal of magnetized container residues by means of magnetic field, etc.). Since, for example, glass is inert to most substances or physical conditions used in chemical or biochemical research, it permits in most cases all the options described, and it is up to the user to decide when and whether at all he removes the container residues. In many cases, particularly in the area of chemical development or process development, it may even be advantageous (with regard to cost, etc.) if the container residues are not removed at all, particularly in the case of glass. In other cases, they may be removed, for example, only after the reaction, for example during the working-up of the reaction mixture, after the working-up of the reaction mixture, etc. This not only dispenses with the need to dispose of container residues which may be contaminated (potential health hazard, potential environmental hazard, etc.) but saves the experimenter the possibly complicated removal, the use of a possibly expensive tool, etc. The container residues are not removed, for example, when the experimenter is interested only in the process data and not in the product. The container residues can then be disposed of together with the reaction medium (in this case the product) or with the working-up residue. This also has the advantage that the experimenter does not have to dispose of container residues which are often dangerously contaminated in various respects, but only a uniform mixture (product mixture or working-up mixture with container residues).

Ideally, all containers in as wide a millimole range as possible, in each case filled with the substances usually used in chemical or biochemical research are of the same size or of the same size in at least two dimensions. This has the advantage that all containers of substances with a very wide range of filled amounts based on mmol can be stored identically and can be handled identically, especially by, for example, a robot, for storage or for the synthesis itself, and, for example, the reaction vessel openings and further installations required for storage and/or synthesis can be dimensioned correspondingly simply.

As mentioned, the substances are generally used in a certain ratio based on number of atoms or molecules. The system according to the invention thus corresponds to a "millimolarization" of chemistry. The units used are, as a rule, moles or milimoles and no longer kilograms or liters as today in the field of use described. This is critical for enabling the overall system to be made compatible and efficient.

As many as possible of the substances used in chemical research and development should advantageously be available to the experimenter in containers according to the invention so that he is not limited with respect to the absolute amount to be metered, expressed as a measure for the number of atoms, molecules or complexes, etc., if necessary with the use of a multiplicity of containers of the same substance. This means that, if a certain substance is present, for example, at least in the amount $10^{-4}$ mol, but advantageously in two, three, four, etc. different orders of magnitude expedient for the potential applications in chemical research, said substance can be metered accurately to $10^{-4}$ mol using, if necessary, a multiplicity of containers. Advantageously, the other substances used in the same or different chemical reactions are present in the same number of moles in at least one similar container. The same number of moles or at least a number of moles which is a factor thereof is necessary for a properly functioning system, and the similar containers not only facilitate the manual work but permit more easily realizable automation or semiautomation.

Thus, the experimenter can carry out, for example, a chemical reaction in which he has to combine, for example, $10^{-3}$ mol of a substance A with 1.1 equivalents of a substance B by combining 10 containers each filled with $10^{-4}$ mol of the substance A and 11 containers each filled with $10^{-4}$ mol of the substance B, and the substances are released, as described above, either shortly before the addition of the container, during the addition of the container or in the reaction vessel itself in the manner described above.

Furthermore, a gradation should advantageously be effected so that, in the case of an amount which is large relative to the amount of substance in the container, the experimenter can change to the next highest container unit. Thus, the number of containers per reaction can be reduced to a minimum. The example described above is then such that he combines one container filled with $10^{-3}$ mol of the substance A with a container filled with $10^{-3}$ mol of the substance B and a container filled with $10^{-4}$ mol of the substance B in the manner described and carries out the reaction.

The invention claimed is:

1. A method for carrying out a chemical reaction between at least a first substance and a second substance, comprising:

providing a premetered amount of the first substance and a premetered amount of the second substance which is the molar equivalent of the premetered amount of the first substance or is graduated thereto based on mole equivalents, wherein a first premetered amount of the first substance is present in a first container, which is sealed air-tight, and a second premetered amount of the first substance which is the molar equivalent of the first premetered amount of the first substance or is graduated thereto based on mole equivalents is present in a second container, which is sealed air-tight, and providing at least one third container with the premetered amount of the second substance which is the molar equivalent of the premetered amount of the first substance or is graduated thereto based on mole equivalents; and substantially completely releasing the first and second premetered amounts of the first substance from said first and second containers and substantially completely using said first substance in the reaction between at least the first substance and the second substance.

2. The method as claimed in claim 1, wherein the chemical reaction is one of at least two reactions carried out in parallel; and wherein, in each of the at least two reactions, a substance is released from at least one container, which is sealed air-tight and contains a premetered amount of the substance that is released from said at least one container, and the substance which is released from said at least one container is used in the respective reaction.

3. The method as claimed in claim 2, wherein the at least two reactions differ from each other in at least one respect, the at least one respect being selected from a group consisting of reaction conditions, a substance used, and an amount of a substance used.

4. The method as claimed in claim 1 wherein the chemical reaction is a chemical or biochemical synthesis method.

5. The method as claimed in claim 4 wherein a product is prepared which is not a polymer.

6. The method as claimed in claim 1, wherein at least one of the substances is released by at least partial, irreversible elimination of the air-tight seal of at least one of the containers, directly where the reaction takes place.

7. The method as claimed in claim 1, wherein at least one of the first or second substances is released by at least partial, irreversible elimination of the air-tight seal of at least one of the containers and then added to at least one further substance.

8. The method as claimed in claim 6 or 7, wherein the at least partial elimination of the air-tight seal of the at least one of the containers is effected by nontargeted use of a chemical, physical or mechanical effect.

9. The method as claimed in claim 1 wherein the premetered amounts are 1, 2, 5, 10, 20, 50, 100, 200, 500, 1000, 2000, 5000, 10,000, 20,000, 50,000, 100,000, 200,000, 500,000, 1,000,000, 2,000,000, 5,000,000, 10,000,000, 20,000,000, 50,000,000, or 1,000,000,000 nmol.

10. The method as claimed in claim 1, wherein the second container comprises a second premetered amount of the first substance which is graduated relative to the first premetered amount of the first substance based on mole equivalents.

11. The method as claimed in claim 10, wherein the second premetered amount of the first substance is an integral multiple of the first premetered amount of the first substance.

12. The method as claimed in claim 1, further comprising providing at least one fourth container with a premetered amount of the second substance which is graduated relative to the premetered amount of the second substance in the third container based on mole equivalents.

13. The method as claimed claim 1, further comprising at least one further container with a premetered amount of a third substance which is the molar equivalent of the premetered amount of the first substance or is graduated thereto based on mole equivalents.

14. The method as claimed in claim 1, wherein the first container has x nmol of substance and the at least one third container has y·x/1000 nmol of substance, where x and y are integers and y is a number from 1001 to 1,000,000.

15. A set of containers containing substances, which comprises at least one first container with a first premetered amount of a first substance, the first container being irreversibly-openable airtight sealed, at least one second container with a second premetered amount of the first substance which is graduated relative to the first premetered amount based on mole equivalents, the second container being irreversibly-openable air-tight sealed and at least one third container with a premetered amount of a second substance which is the molar equivalent of the first premetered amount or of an integral multiple thereof.

16. The set as claimed in claim 15, wherein the premetered amounts of the first or second or further substances in further containers are in each case molar equivalent amounts of the premetered amount of the first substance in the first container, or integral multiples thereof.

17. The set as claimed in claim 16, wherein at least one of the substances is a pure chemical compound.

18. The set as claimed in claim 15 further comprising at least one fourth container with a premetered amount of the second substance which is graduated relative to the premetered amount of the second substance in the third container based on mole equivalents.

19. The set as claimed in claim 15, wherein the at least one first container contains x nmol of the first substance and the at least one second container contains y·x/1000 nmol of the first substance, where x and y are integers and y is a number from 1001 to 1,000,000.

20. The set as claimed in claim 19, wherein y is 2000, 3000, 4000, 5000, 6000, 7000, 8000, 9000 or 10,000.

21. The set as claimed in claim 19, wherein x is 1, 2, 5, 10, 20, 50, 100, 200, 500, 1000, 2000, 5000, 10,000, 20,000, 50,000, 100,000, 200,000, 500,000, 1,000,000, 2,000,000, 5,000,000, 10,000,000, 20,000,000, 50,000,000, or 1,000,000,000.

22. The set as claimed in claim 15 comprising at least three containers with different substances.

23. The set as claimed in claim 22, comprising in addition to the containers with different substances in each case at least one further container with the same substance in an amount graduated relative to the first premetered amount of the respective substance based on mole equivalents.

24. The set as claimed in claim 15, wherein at least one of the containers does not contain a molar solution.

25. The set as claimed in claim 15, wherein, in the containers, any space not filled with the substance is substantially completely filled with a gas, a mixture of gases or a liquid, which gas, mixture or liquid contains less than 1% of $O_2$.

26. The set as claimed in claim 15, wherein, in at least one of the containers, the space not filled with substance is substantially completely filled with an inert gas.

27. The set as claimed in claim 15, wherein the substance in at least one of the containers is a catalyst, inhibitor, initiator or an accelerator.

28. The set as claimed in claim 15, wherein the containers are sealed air-tight, the air-tight seal of the containers being capable of being at least partly irreversibly eliminated.

29. The set as claimed in claim 15, wherein the containers have a container wall thickness of from 0.02 mm to 0.3 mm.

30. The set as claimed in claim 15, wherein the largest diameter of the containers are of the same magnitude.

31. The set as claimed in claim 15, wherein the containers are provided with a substance designation or quantity specification.

32. The set as claimed in claim 15, wherein a plurality of containers is arranged in a matrix which, for carrying out a plurality of chemical reactions, can be mounted directly on a matrix of reaction vessels or an automatic laboratory apparatus, the containers in the matrix being capable of being transported individually, together or group by group into the reaction vessels.

33. The set as claimed in claim 15, wherein at least one of the substances is a mixture of characterized chemical compounds.

* * * * *

UNITED STATES PATENT AND TRADEMARK OFFICE

CERTIFICATE OF CORRECTION

PATENT NO. : 8,709,361 B2
APPLICATION NO. : 10/344839
DATED : April 29, 2014
INVENTOR(S) : Gueller et al.

It is certified that error appears in the above-identified patent and that said Letters Patent is hereby corrected as shown below:

In the Specification:

In column 33, line 36, delete "10 M $HB_{raq}$" and substitute therefor --10 M $HBr_{aq}$--.

In column 33, line 67, delete "10 M $HB_{raq}$" and substitute therefor --10 M $HBr_{aq}$--.

In the Claims:

In column 41, line 43 (first line of claim 17), delete "claim 16" and substitute therefor --claim 15--.

Signed and Sealed this
Eighth Day of July, 2014

Michelle K. Lee

Michelle K. Lee
*Deputy Director of the United States Patent and Trademark Office*